US008288640B2

(12) United States Patent
Yaguchi et al.

(10) Patent No.: US 8,288,640 B2
(45) Date of Patent: Oct. 16, 2012

(54) KEYBOARD APPARATUS

(75) Inventors: Nariyasu Yaguchi, Hamamatsu (JP); Akihiko Komatsu, Hamamatsu (JP); Yoshinori Hayashi, Iwata (JP)

(73) Assignee: Yamaha Corporation (JP)

( * ) Notice: Subject to any disclaimer, the term of this patent is extended or adjusted under 35 U.S.C. 154(b) by 67 days.

(21) Appl. No.: 12/823,955

(22) Filed: Jun. 25, 2010

(65) Prior Publication Data

US 2010/0326257 A1 Dec. 30, 2010

(30) Foreign Application Priority Data

Jun. 25, 2009 (JP) ..... 2009-151651
Jun. 25, 2009 (JP) ..... 2009-151652

(51) Int. Cl.
*G10F 1/04* (2006.01)

(52) U.S. Cl. ..... 84/626; 84/658; 84/687; 84/17; 84/22

(58) Field of Classification Search ..... 84/16–23, 84/615, 626, 653, 658, 687–744
See application file for complete search history.

(56) References Cited

U.S. PATENT DOCUMENTS 4,194,428 A 3/1980 McFarlin
5,451,706 A * 9/1995 Yamamoto et al. ..... 84/34
5,714,702 A * 2/1998 Ishii ..... 84/462
5,880,389 A * 3/1999 Muramatsu ..... 84/615
5,994,632 A * 11/1999 Muramatsu et al. ..... 84/18
6,525,257 B1 * 2/2003 Hermann ..... 84/658

(Continued)

FOREIGN PATENT DOCUMENTS

DE 4414110 A1 11/1995

(Continued)

OTHER PUBLICATIONS

Extended European Search Report issued in corresponding European Patent Application No. 10166966.1 dated Nov. 3, 2010.

(Continued)

*Primary Examiner* — David S. Warren
(74) *Attorney, Agent, or Firm* — Rossi, Kimms & McDowell LLP

(57) ABSTRACT

In a keyboard apparatus including a key supported for pivoting movement about a pivot point, a mass member that imparts a reaction force to performance operation of the key in interlocked relation to the key, and an electromagnetic actuator provided between the key and the mass member for imparting a driving force to the key and mass member, a transmission member is provided in detachable abutment with the key and mass member. The transmission member can be disengaged from the key or the mass member depending on operating conditions of the key and the mass member. Thus, it is possible to not only prevent unnecessary binding forces from acting in areas where the transmission member and the key and the mass member abut against each other, but also achieve smooth movement of the key and the mass member and prevent increase of inertial mass of the transmission member. The smooth movement of the key and mass member can achieve force sense control with good responsiveness. Further, the key is pivotable in a key depressing direction as a reaction force imparted from the mass member is reduced by impartment, to the key, of a driving force by the actuator. Thus, the apparatus can perform both force sense control on depression operation of the key and an automatic performance involving automatic operation of the key, through cooperation between a reaction force imparted from the mass member to the key and the driving force imparted from the actuator to the key.

17 Claims, 11 Drawing Sheets

U.S. PATENT DOCUMENTS

| | | | | |
|---|---|---|---|---|
| 6,781,046 | B2 * | 8/2004 | Meisel | 84/20 |
| 6,888,052 | B2 * | 5/2005 | Meisel | 84/16 |
| 6,891,092 | B2 * | 5/2005 | Meisel | 84/16 |
| 7,019,201 | B2 * | 3/2006 | Meisel | 84/16 |
| 7,166,795 | B2 * | 1/2007 | Lengeling | 84/737 |
| 7,238,868 | B2 * | 7/2007 | Muramatsu et al. | 84/20 |
| 7,547,833 | B2 * | 6/2009 | Yamashita | 84/18 |
| 7,786,368 | B2 * | 8/2010 | Muramatsu | 84/615 |
| 8,138,402 | B2 * | 3/2012 | Komatsu | 84/22 |
| 2001/0000569 | A1 * | 5/2001 | Meisel | 84/688 |
| 2001/0037723 | A1 * | 11/2001 | Nishida et al. | 84/744 |
| 2002/0184989 | A1 * | 12/2002 | Meisel | 84/216 |
| 2005/0139060 | A1 * | 6/2005 | Muramatsu | 84/719 |
| 2005/0188810 | A1 * | 9/2005 | Meisel | 84/16 |
| 2009/0013856 | A1 * | 1/2009 | Fujiwara et al. | 84/626 |
| 2009/0019997 | A1 * | 1/2009 | Muramatsu | 84/626 |
| 2009/0100986 | A1 | 4/2009 | Komatsu | |
| 2010/0031803 | A1 | 2/2010 | Lozada et al. | |
| 2010/0229708 | A1 * | 9/2010 | Komatsu | 84/22 |
| 2010/0326257 | A1 * | 12/2010 | Yaguchi et al. | 84/687 |
| 2010/0326260 | A1 * | 12/2010 | Komatsu et al. | 84/744 |
| 2011/0067557 | A1 * | 3/2011 | Komatsu et al. | 84/744 |

FOREIGN PATENT DOCUMENTS

| | | | |
|---|---|---|---|
| EP | 2 015 289 | A2 | 1/2009 |
| FR | 2 704 968 | A1 | 11/1994 |
| FR | 2902538 | A1 | 12/2007 |
| GB | 2331831 | A | 6/1999 |
| JP | 2956180 | B2 | 10/1999 |
| JP | 3644136 | B2 | 4/2005 |
| JP | 2005-195619 | A | 7/2005 |
| RU | 2084967 | C1 | 7/1997 |
| WO | 98/13817 | A1 | 4/1998 |

OTHER PUBLICATIONS

Partial European Search Report issued Nov. 8, 2010 for EP 10166965.3; Cited in related co-pending U.S. Appl. No. 12/823,931.

Extended European Search Report issued Feb. 8, 2011 for EP 10166965.3; Cited in related co-pending U.S. Appl. No. 12/823,931.

CN OA issued Feb. 22, 2012 for CN201010220096.4; cited in related US 2011-0067557 (English translation provided).

* cited by examiner

KEYBOARD APPARATUS

This application is based on, and claims priorities to, JP PA 2009-151651 filed on 25 Jun. 2009 and JP PA 2009-151652 filed on 25 Jun. 2009. The disclosures of the priority applications, in their entirety, including the drawings, claims, and the specifications thereof, are incorporated herein by reference.

BACKGROUND

The present invention relates generally to keyboard apparatus provided in electronic keyboard instruments etc., and more particularly to a keyboard apparatus provided with force sense control and operation control functions for controlling an operational feeling and behavior of keys.

Keyboard units of natural keyboard instruments, such as acoustic pianos, which generate raw tones, are constructed to generate a tone by a hammer, pivoting in response to depression of a key, striking strings. In these keyboard units, an action mechanism, including a jack and a wippen, is provided between each key and a corresponding hammer. Such an action mechanism allows a characteristic reaction force to be applied from the key to a human player's finger. Thus, in the keyboard unit of a natural keyboard instrument, a key touch feeling characteristic of, or unique to, the keyboard instrument can be obtained.

Keyboard units of electronic keyboard instruments which generate electronic tones, on the other hand, include, among others, a spring and a mass member (pseudo hammer) for returning a depressed key to an initial position, and these keyboard units simulate a key touch feeling of a natural keyboard instrument through a reaction force provided by the spring and mass member. However, in the electronic keyboard instruments, which generate an electronic tone in response to depression of a key, there is provided no mechanism that actually strikes strings to generate an electronic tone and hence no complicated action mechanism as in the natural keyboard instruments. Consequently, the keyboard units of the electronic keyboard instruments cannot faithfully reproduce a key touch feeling provided through the action mechanism of the natural keyboard instruments, and thus, strictly speaking, the key touch feeling provided by the electronic keyboard instruments is different from that provided by the natural keyboard instruments.

Therefore, in the field of the electronic keyboard instruments, there have been proposed key drive and control devices (force sense control means) for changing a reaction force responsive to depression of a key with a view to achieving behavior of the key and key touch feeling approximate to that provided by the natural keyboard instruments. For example, a keyboard unit disclosed in Japanese Patent No. 2956180 (hereinafter referred to as "Patent Literature 1") includes an actuator (solenoid) for driving a key and a control means for controlling the actuator. Thus, the keyboard unit disclosed in Patent Literature 1 can simulate a performance feeling of a natural keyboard instrument by appropriately adjusting a key touch feeling.

Further, a keyboard apparatus disclosed in Japanese Patent Application Laid-open Publication No. 2005-195619 (hereinafter referred to as "Patent Literature 2") includes a mass member simulating a hammer member of an acoustic piano, and an inertial load of the mass member is imparted as a reaction force to operation of a corresponding key. The disclosed keyboard apparatus also has a force sense control function in which other necessary viscous, elastic and frictional loads etc. are generated by an actuator (solenoid). The keyboard apparatus disclosed in Patent Literature 2 can create a key touch feeling approximate to that of an acoustic piano through cooperation between the mass member and the actuator.

Furthermore, in a keyboard apparatus disclosed in Japanese Patent No. 3644136 (hereinafter referred to as "Patent Literature 3"), a key is normally biased in both of key depressing and key releasing directions by springs, acting in the key depressing and key releasing directions, respectively, so that the key is balanced at its rest position. The key is driven by a bidirectional actuator, so that the disclosed keyboard apparatus can achieve both force sense control on key depression operation and an automatic performance.

With the keyboard unit disclosed in Patent Literature 1, where behavior of the key is controlled by the solenoid alone, it is difficult to replicate or reproduce a key touch feeling of an acoustic piano with high accuracy. Further, in the keyboard apparatus disclosed in Patent Literature 2, the actuator is provided in abutment with the key so as to directly impart a reaction force to the key. Further, although the mass member is also provided in abutment with the key so as to operate in interlocked relation with the movement of the key, it is not in abutment with the actuator; namely, the mass member and the actuator are provided at separate positions. Thus, these separately-provided mass member and actuator have different operating systems, so that there are limitations to appropriately controlling, through driving of the actuator, a load applied from the mass member to the key.

Further, in the known keyboard apparatus including a key and a mass member operating in interlocked relation to the key, a driving force is transmitted between the key and mass member and another component part interposed therebetween in a driving force transmission path between the key and the mass member. In this case, the key and mass member and the other component part are provided to often perform mutually-different movement, such as pivoting movement and linear movement. Therefore, in order to achieve a more natural operational feeling through force sense control on the key, it is necessary to secure smooth movement or operation of various component parts including the key and the mass member and smooth driving force transmission between the component parts.

Further, the keyboard apparatus disclosed in Patent Literature 3 includes the key-biasing springs as main elements for controlling behavior of the key. However, in the case where the behavior of the key is controlled by the springs, even if auxiliary force sense control of the key is performed through driving of the actuator, the keyboard apparatus disclosed in Patent Literature 3 cannot faithfully reproduce an inertial mass feeling characteristic of behavior of a key of a natural keyboard instrument, such as an acoustic piano. Particularly, whereas, in an acoustic piano, movement of a key has to be started at the start of depression of the key against a static load of a string-striking hammer, it is difficult for the keyboard apparatus disclosed in Patent Literature 3 to appropriately reproduce an operational feeling at the start of depression of a key on an acoustic piano. Further, even if the springs provided in the keyboard apparatus disclosed in Patent Literature 3 are replaced with a mass member that generates an inertial force in interlocked relation to movement of the key, a possibility of properly controlling a load applied from the mass member to the key through driving of the actuator would be limited because the mass member is provided separately from the actuator and because the mass member and the actuator differ in operating system. Therefore, it is necessary to further improve the keyboard apparatus, in order to create a key touch feeling more approximate to that of a natural keyboard instrument and permit an automatic performance with smooth movement of the keys.

SUMMARY OF THE INVENTION

In view of the foregoing, it is an object of the present invention to provide an improved keyboard apparatus which is simple in construction and yet can achieve creation of a key touch feeling approximate to that of a natural keyboard instrument by achieving smooth driving force transmission between component parts, such as a key and a mass member.

It is another object of the present invention to provide an improved keyboard apparatus which is simple in construction and yet can achieve creation of a key touch feeling extremely approximate to that of a natural keyboard instrument through force sense control and achieve an automatic performance with smooth movement of keys.

According to a first aspect according to the present invention, a keyboard apparatus includes a key, a mass member, a driving force imparting section, and a control section. The key is supported for pivoting movement about a key pivot point. The mass member imparts a reaction force to performance operation of the key in interlocked relation to movement of the key. The driving force imparting section is provided between the key and the mass member and imparts a driving force to the key and the mass member. The control section controls generation of the driving force by the driving force imparting section. The driving force imparting section comprises an actuator that includes a transmission member provided in abutment with both of the key and the mass member to transmit a load from one of the key or the mass member to the other of the key or the mass member, and a drive source that drives the transmission member toward at least one of the key or the mass member. The transmission member is provided in detachable abutment with the key and the mass member so that the transmission member is disengageable from either the key or the mass member depending on operating conditions of the key or the mass member.

The detachable abutment refers to the arrangement where the transmission member is always held in abutment with the key and the mass member while the key and the mass member are at their rest positions. But, once a force acts between the key and the transmission member or between the mass member and the transmission member to disengage the key or mass member and the transmission member from each other during movement of the key and mass member, the detachable abutment allows the transmission member to be disengaged or detached from the key or mass member.

The present arrangement allows a same operating system to share between the mass member acting on the key and the driving force imparting section (i.e., the operating system of the mass member and the operating system of the driving force imparting section can be constructed as a single common operating system). Thus, a load acting from one of the key or mass member to the other can be appropriately controlled by the driving force imparting section, to appropriately perform force sense control and driving control on the key.

The transmission member can be disengaged or detached from either the key or the mass member depending on operating conditions of the key and the mass member. Often, the key and the mass member and the transmission member are provided to perform different movement, i.e., pivoting movement and linear movement. In such a case, sliding movement necessarily takes place in areas where the key and the mass member and the transmission member abut against with each other. Consequently, if the key and the mass member and the transmission member are not detachably connected with each other in the abutment areas as in the conventionally-known keyboard apparatus, great binding forces would occur due to increase of normal forces and friction regions and the like, which would impede smooth movement of the key and the mass member.

Therefore, the present keyboard apparatus is provided with the transmission member that is in detachable abutment with the key or the mass member to allow the transmission member to be disengaged or detached from either the key or the mass member depending on operation conditions of the key and the mass member. This makes it possible to prevent unnecessary binding forces from occurring in the abutment areas. As a result, the present keyboard apparatus can achieve smooth movement of the key and the mass member to achieve force sense control with good responsiveness.

If the key and the mass member and the transmission member are not detachably connected with each other in the abutment areas, the key and the mass member and the transmission member would always move integrally with each other, which is equivalent to a case where the inertial mass of the transmission member is increased by an amount corresponding to the inertial mass of the key and the mass member. Thus, when the transmission member is to be driven by the driving force imparting section, the transmission member would move only with poor responsiveness. To enhance the operational responsiveness, the driving force imparting section would require increased driving energy (such as increased driving voltage). The present keyboard apparatus can prevent increase of the inertial mass of the transmission member. Therefore, when the transmission member is to be driven by the driving force imparting section, it is possible to not only secure good operational responsiveness of the transmission member, but also save necessary energy for driving the transmission member.

The mass member can be provided for pivoting movement in a region over the key, and the transmission member can be provided in abutment with a portion of the key located on an opposite side from a key depression section of the key with respect to (i.e., as viewed from) the key pivot point and in abutment with the mass member. Such a construction is equivalent to a construction where a wippen assembly disposed between a key and a hammer in an action mechanism of an acoustic piano, which can be replaced with the driving force imparting section and transmission member. Thus, by the driving force imparting section and transmission member performing the function of the wippen assembly of an acoustic piano, the present keyboard apparatus can achieve a key touch feeling extremely approximate to that of an acoustic piano with minimum necessary structural arrangements and control. In addition, the present keyboard apparatus can perform an automatic performance involving automatic operation of the keys.

The driving force imparting section can be an electromagnetic actuator including a coil, which can be the drive source, and a plunger, which can be the transmission member, driven by the coil. Thus, the keyboard apparatus of the present invention can perform appropriate driving control on the transmission member while permitting simplification and size reduction of the driving force imparting section. As a result, the present keyboard apparatus can perform appropriate force sense control by adjusting the reaction force imparted from the mass member to depression operation of the key.

The keyboard apparatus can include at least one operation detection section that detects operation of at least one of the transmission member, the key, or the mass member. The control section can control, on the basis of detection results of the operation detection section, a driving force to be generated by the driving force imparting section. Because force sense control can be performed on the key on the basis of actual operation of the transmission member, the key and the mass member, the present keyboard apparatus can achieve a good operational feeling of the key.

The transmission member can be linearly movable between the key and the mass member, and abutting angles between the transmission member and the key and between the transmission member and the mass member can be set to minimize amounts of contacting-sliding movement of the transmission member relative to the key and the mass member responsive to movement of the key and the mass member.

When the mass member and the key move, such an arrangement can minimize influences on sliding movement between the transmission member and the mass member and the key and movement in the abutment areas where the transmission member and the mass member and the key abut against each other, to allow smooth movement of the mass member and the key. As a result, the present keyboard apparatus can create a key touch feeling more approximate to that of a natural keyboard instrument, such as an acoustic piano.

The keyboard apparatus according to the first aspect can create, even with a simple construction, a key touch feeling approximate to that of a natural keyboard instrument to achieve smooth driving force transmission between the component parts, such as the key and the mass member.

According to a second aspect according to the present invention, The keyboard apparatus includes the key supported for pivoting movement about a key pivot point, a mass member that normally biases the key in a key releasing direction to impart a reaction force to performance operation of the key in interlocked relation to movement of the key, a driving force imparting section that imparts a driving force to the key and the mass member, and a control section that controls generation of the driving force by the driving force imparting section. The key is pivotable in a key depressing direction as the reaction force imparted from the mass member to the key is reduced by imparting the driving force by the driving force imparting section to the key. When depression operation has been performed on the key, force sense control is performed through cooperation between the reaction force imparted from the mass member to the key and the driving force imparted from the driving force imparting section to the key. Even in the absence of depression operation on the key, automatic operation of the key can be made through the cooperation between the reaction force imparted from the mass member to the key and the driving force imparted from the driving force imparting section to the key. Note that the key depressing direction means the direction in which the key is depressed from a non-depressed position (or initial position) by depression operation by a human player while the key releasing direction means the direction where the depressed key returns to the non-depressed position.

The above arrangement allows the keyboard apparatus to more faithfully reproduce an inertial mass feeling characteristic of behavior of a key in a natural keyboard instrument, such as an acoustic piano, than the conventionally-known keyboard apparatus provided with a spring. Further, the present keyboard apparatus also can appropriately reproduce an operational feeling at the start of depression of a key in an acoustic piano where movement of the key has to be started against the static load of the corresponding hammer. Further, the present keyboard apparatus can perform both force sense control on depression operation of the key and automatic movement or operation of the key through cooperation between the reaction force applied from the mass member to the key and the driving force imparted from the driving force imparting section. By having both the reaction force of the mass member and the driving force of the driving force imparting section imparted to the key, the intensity of the reaction force acting from the mass member on the key in the key releasing direction can be adjusted by the driving force of the driving force imparting section. In this way, the present keyboard apparatus can achieve both creation of a key touch feeling extremely approximate to that in a natural keyboard instrument through the force sense control on depression operation of the key and an automatic performance with automatic operation of the key.

When the key is not being depressed, the load applied, in the key releasing direction, from the mass member is greater than a biasing force, in the key depressing direction, applied by the self-weight of the key, and thus, the key is held in a key-released position. Thus, an arrangement can be made so that the key is caused to pivot in the key depressing direction as the load (reaction force) from the mass member is reduced by the driving force of the driving force imparting section, so that the biasing force, in the key depressing direction, applied by the self-weight of the key becomes greater than the load applied, in the key releasing direction, from the mass member. In this way, even where the driving force of the driving force imparting section is relatively small, the keyboard apparatus can achieve appropriate behavior of the key while permitting simplification and size reduction of the driving force imparting section.

Furthermore, the present keyboard apparatus can further include a transmission member provided in abutment with both of the key and the mass member to transmit a load from one of the key and the mass member to the other of the key or the mass member. The driving force imparting section can be a bi-directionally-driven actuator that drives the transmission member toward both of the key and the mass member. In this way, even where the driving force imparting section is simple in construction, the same operating system can be shared between the key and the mass member and the driving force imparting section (i.e., the operating system of the key and mass member and the operating system of the driving force imparting section can be constructed as a single common operating system). Thus, a load acting from one of the key or the mass member to the other can be appropriately controlled, allowing the present keyboard apparatus to appropriately perform force sense control and behavioral control on the key.

The mass member can be provided for pivoting movement in a region over the key, and the transmission member can be provided in abutment with a portion of the key located on an opposite side from a key depression section of the key with respect to the key pivot point and in abutment with the mass member. This arrangement is equivalent to a construction where a wippen assembly is disposed between a key and a hammer in an action mechanism of an acoustic piano, which can be replaced with the driving force imparting section and transmission member. Thus, by the driving force imparting section and transmission member performing the function of the wippen assembly of an acoustic piano, the present keyboard apparatus can achieve a key touch feeling extremely approximate to that of an acoustic piano with minimum necessary structural arrangements and control. In addition, the present keyboard apparatus can perform an automatic performance involving automatic operation of the keys.

When the key pivots in the key releasing direction during the automatic operation of the key, the key can be imparted with, in addition to the reaction force from the mass member, the driving force generated by the driving force imparting section and acting in the key releasing direction. In this way, the present keyboard apparatus can enhance operational responsiveness and thereby achieve an improved operational appearance of the key and enhanced quality of an automatic performance.

The automatic operation of the key can be performed by the driving force imparted by the driving force imparting section being controlled on the basis of automatic performance data stored in a storage section, and during the automatic operation of the key, operating velocities, in the key depressing and key releasing directions, of the key can be controlled by driving forces acting in both of the key depressing and key releasing directions being imparted to the key by the driving force imparting section on the basis of the automatic performance data. With such an arrangement, the driving force imparting section can be controlled in the two directions on the basis of the automatic performance data, so that the moving velocity of the key responsive to depression/release operation can be adjusted to a desired velocity. As a result, the keyboard apparatus can visually reproduce rapid and slow key depression and release operation and improve quality of an automatic performance.

The keyboard apparatus can include at least one operation detection section that detect operation of at least one of the transmission member, the key, or the mass member, and the control section can control, on the basis of detection results of the operation detection sections, the driving force to be generated by the driving force imparting section. With such an arrangement, force sense control can be performed on the key on the basis of actual operation of the transmission member, the key, and the mass member. Thus, the present keyboard apparatus can achieve a good operational feeling of the key.

The keyboard apparatus according to the second aspect also can achieve, with a simple construction, both creation of a key touch feeling extremely approximate to that in a natural keyboard instrument through the force sense control and an automatic performance with automatic operation of the key.

The following will describe embodiments according to the present disclosure, but it should be appreciated that the present invention is not limited to the described embodiments and various modifications of the present invention are possible without departing from the basic principles.

BRIEF DESCRIPTION OF THE DRAWINGS

For better understanding of the object and other features of the present invention, its preferred embodiments will be described hereinbelow in greater detail with reference to the accompanying drawings.

FIGS. 4A and 4B are views explanatory of the key and a mass member, of which FIG. 4A shows a state where the key is in a non-depressed position while FIG. 4B shows a state where the key is in a depressed position.

DETAILED DESCRIPTION

Figure 1:
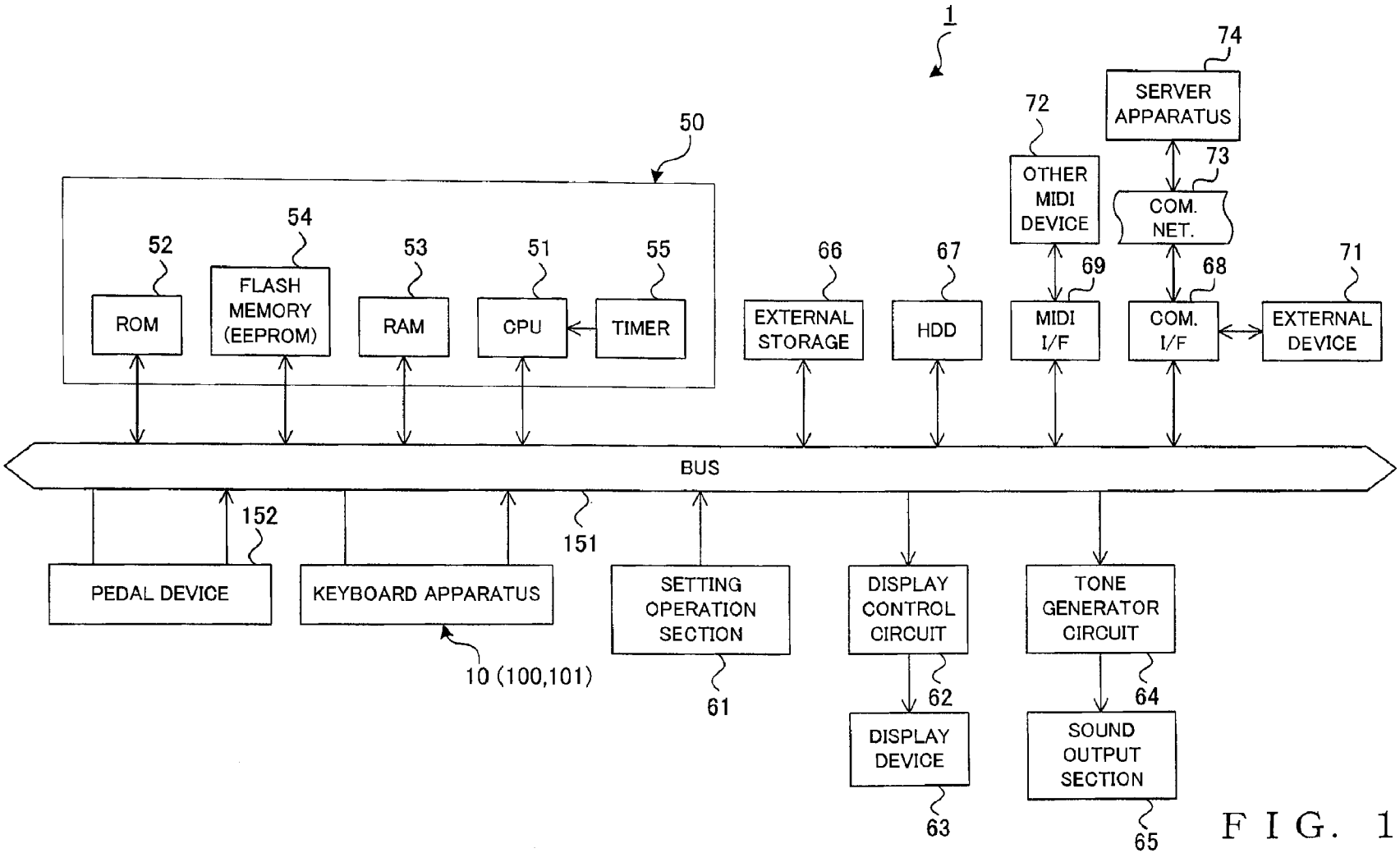
FIG. 1 is a block diagram showing an example general setup of an electronic keyboard instrument provided with an embodiment of a keyboard apparatus of the present invention.

FIG. 1 is an overview block diagram showing an example general setup of an electronic keyboard instrument provided with an embodiment of a keyboard apparatus of the present invention. The electronic keyboard instrument 1 shown in FIG. 1 includes the keyboard apparatus 10 (or 100 or 101) having a plurality of keys 20, a pedal device 152, and a main control section 50 for controlling the entire electronic keyboard instrument 1 including the keyboard apparatus 10 and pedal device 152. Various components, such as the keyboard apparatus 10, pedal device 152 and main control section 50, are interconnected via a bus 151.

[First Embodiment]

First, first to fourth embodiments will be described, with reference to FIGS. 2 to 10, as embodiments employing novel arrangements common to first and second aspects of the present invention.

Figure 2:
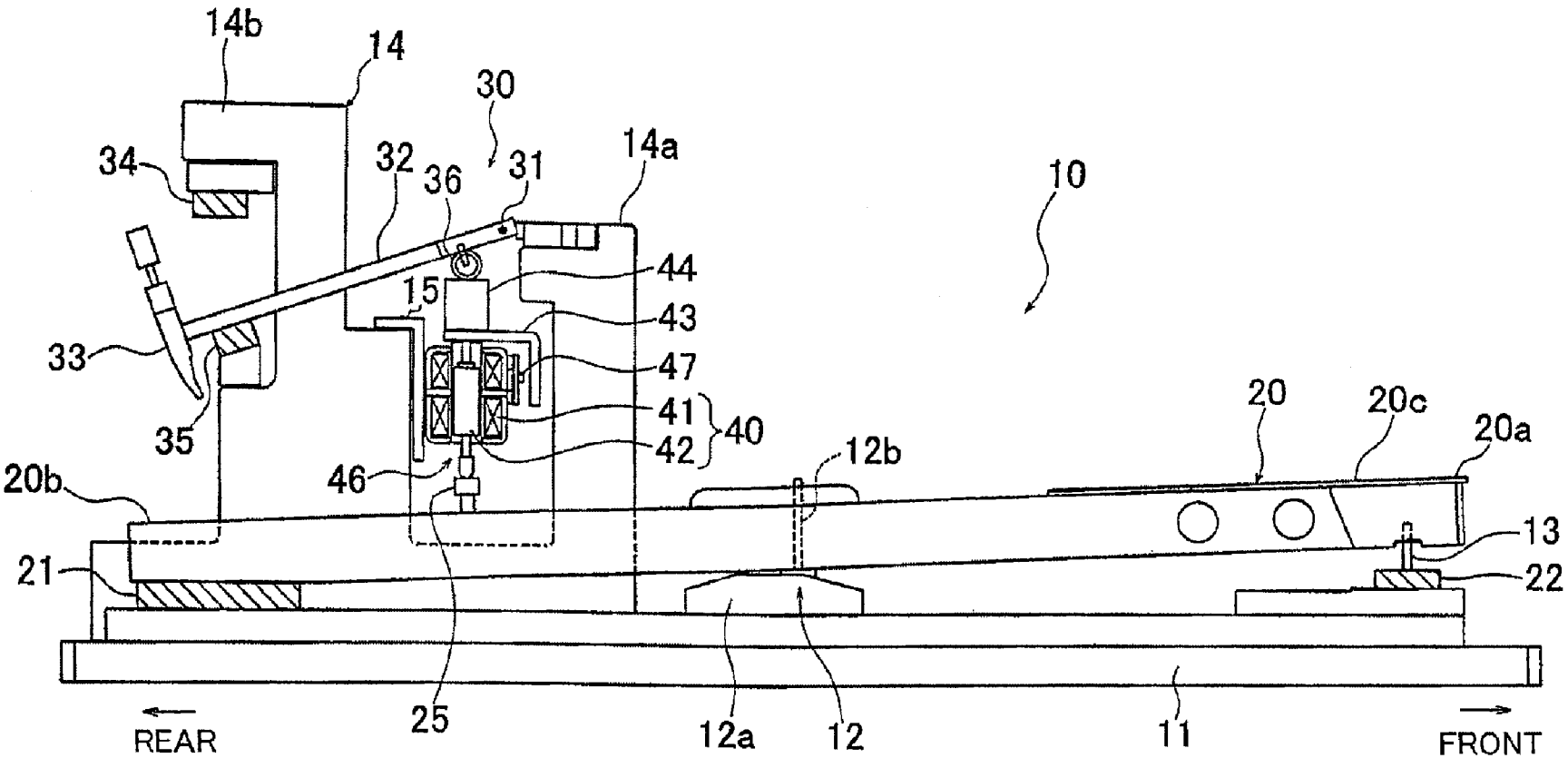
FIG. 2 is a schematic side view of a first embodiment of the keyboard apparatus of the present invention, which particularly shows one of the keys and other component parts around the key.
Figure 3:
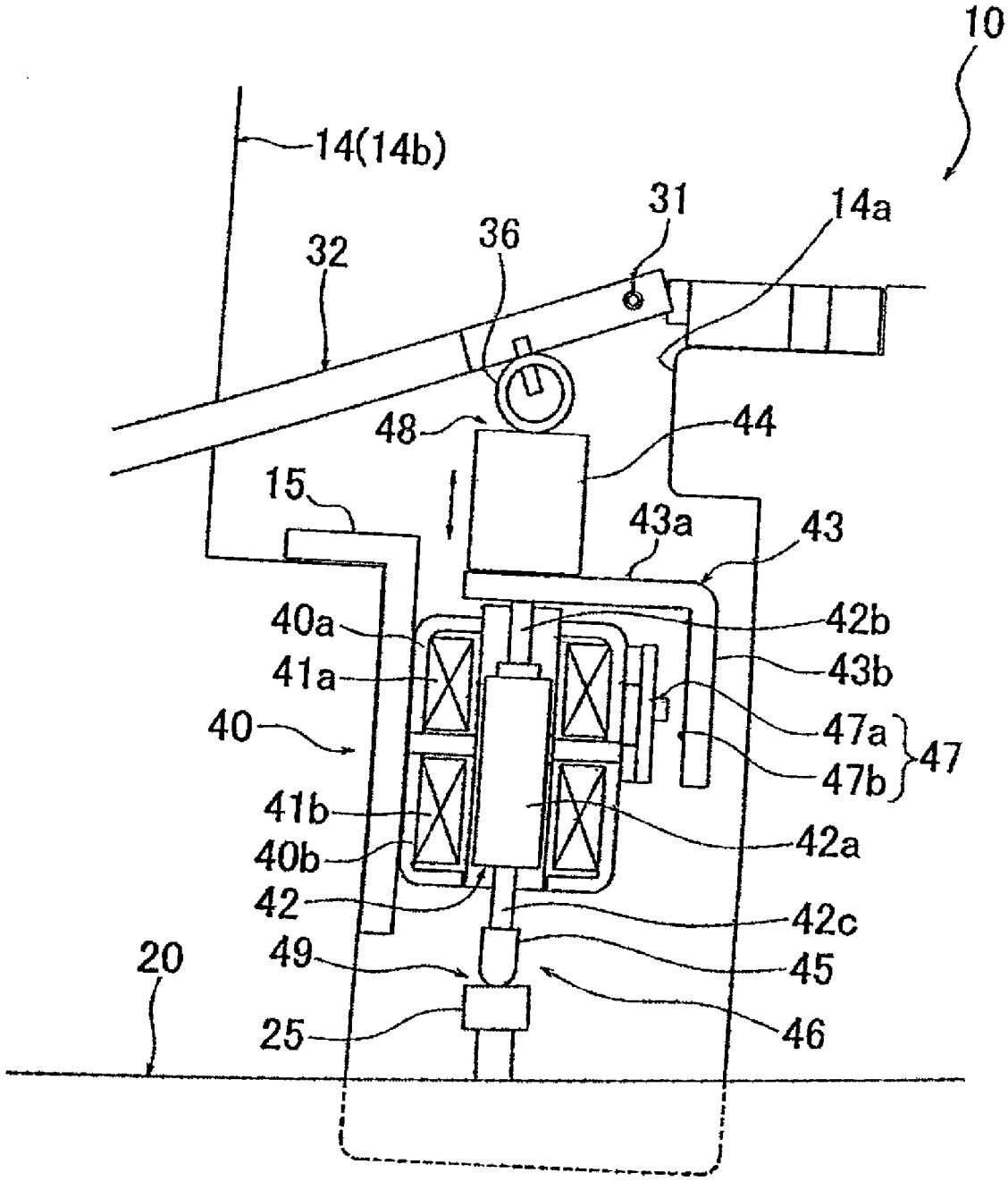
FIG. 3 is a fragmentary enlarged side view showing detailed constructions of an electromagnetic actuator and other component parts around the actuator.
Figure 4A:
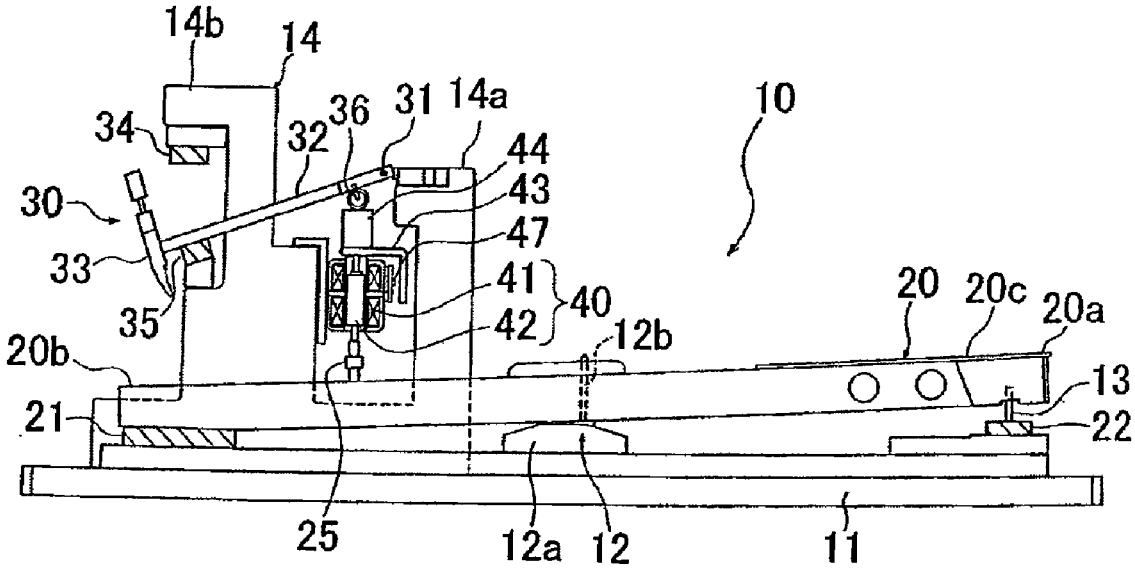
Figure 4B:
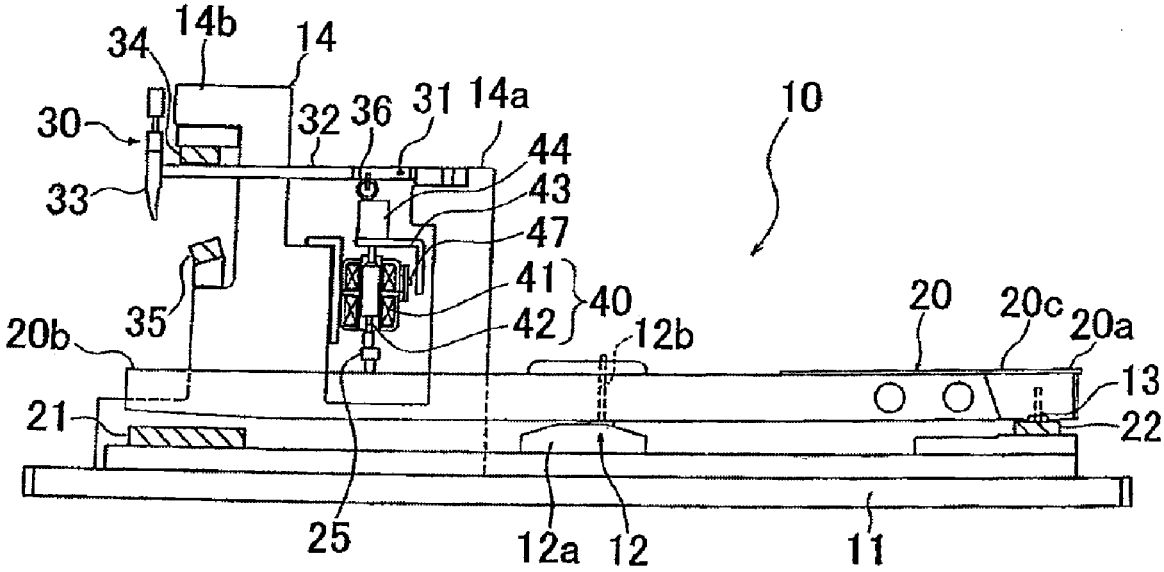

FIG. 2 is a schematic side view of the first embodiment of the keyboard apparatus 10, which particularly shows one of the keys 20 and other component parts around the key 20. FIG. 3 is a fragmentary enlarged side view showing detailed constructions of a later-described electromagnetic actuator (driving force imparting section) 40 and other component parts around the actuator 40. Further, FIG. 4 is a view explanatory of behavior of the keyboard apparatus 10, of which FIG. 4A shows a state where the key 20 is in a non-depressed position while FIG. 4B shows a state in which the key 20 is in a depressed position. The keyboard apparatus 10 includes a frame 11 of a flat plate shape that forms part of the electronic keyboard instrument 1, the keys 20 and mass members (i.e., pseudo hammers) 30 each pivotably supported on the frame 11, and the electromagnetic actuators 40 each provided between the corresponding key and mass member 30. Hereinafter, one of opposite sides of the electronic keyboard instrument 1 (corresponding to opposite longitudinal ends of the individual keys 20) which is located closer to a human player will be referred to as "front", while the other of the opposite sides of the electronic keyboard instrument 1 which is located opposite from the one side will be referred to as "rear". Note that FIG. 2 shows only one of a plurality of the keys 20 provided in parallel to one another in the keyboard apparatus 10 and other component parts around the one key 20. Further, although the key 20 shown in FIG. 2 is a white key, the following description also applies to a black key 20. Further, although not particularly shown, the keyboard apparatus 10 further includes other mechanisms, such as a switch contact mechanism for converting motion or movement of the key 20 into an electric output and a volume detection section, so that a tone corresponding to the movement of the key 20 can be generated.

The key 20 is supported at its longitudinal middle position (i.e., middle position in a front-rear direction of the key 20)

for vertical pivoting movement about a key fulcrum or key pivot point 12 of the frame 11. More specifically, the key 20 is supported on a support pin 12*b* that projects upward from a balance rail 12*a* extending horizontally across the keys 20 (i.e. in a key-arranged direction) on the frame 11. The key 20 is vertically pivotable, in response to human player's depression operation on a key depression section 20*c*, about the support pin 12*b* in such a manner that its front end region 20*a* and rear end region 20*b* can angularly move about the key pivot point 12 in an up-down direction. Further, a front pin 13 is provided under the front end region 20*a* of the key 20 to project upward from the frame 11 and has its upper end inserted in an underside of a front end region 20*a* of the key 20. Thus, the front pin 13 functions to prevent lateral swing of the front end region 20*a* of the vertically pivoting key 20.

An upper key's pivoting movement limiting stopper (hereinafter "upper key limit stopper") 21 is provided under the rear end region 20*b* of the key 20, while a lower key's pivoting movement limiting stopper (hereinafter "lower key limit stopper") 22 is provided under the front end region 20*a* of the key 20. Each of the upper key limit stopper 21 and lower key limit stopper 22 includes a shock absorbing material, such as felt, fixedly attached to the upper surface of the frame 11. The upper key limit stopper 21 abuts against the lower surface of the rear end region 20*b* of the key 20 when the key 20 is in the non-depressed position shown in FIG. 4A, to thereby restrict pivoting movement, in a counterclockwise direction of FIG. 2, of the key 20 in the non-depressed position. Similarly, the lower key limit stopper 22 abuts against the lower surface of the front end region 20*a* of the key 20 when the key 20 is in the depressed position shown in FIG. 4B, to thereby restrict pivoting movement, in a clockwise direction of FIG. 2, of the key 20 in the depressed position.

Further, a post-shaped support section 14 for supporting the mass member 30 is provided on a portion of the frame 11 located rearwardly of the key pivot point 12. More specifically, one such support section 14 is provided on the frame 11 per a predetermined plurality of the keys and projects upwardly from between adjacent ones of the keys 20. The support section 14 includes front and rear walls 14*a* and 14*b* provided at a predetermined horizontal interval from each other. The front and rear walls 14*a* and 14*b* each project vertically upward above the key 20.

A plurality of the mass members 30 supported by the support section 14 are provided in one-to-one corresponding relation to the keys 20 and each located immediately over the corresponding key 20 and rearwardly of the corresponding key pivot point 12. The mass member 30 includes a shank section (or arm section) 32 of a linear rod shape extending rearwardly from a mass member fulcrum or pivot point 31 that is provided at the upper end of the front wall 14*a* of the support section 14, and a mass section (i.e., weight) 33 having a predetermined mass and provided at the distal end of the shank section 32. The shank section 32 is supported for vertical pivoting movement about the pivot point 31; more specifically, the shank section 32 is pivotable in a vertical plane lying orthogonal to the length of the key 20. The mass section 33 is formed in a rod shape extending along a pivoting direction of the shank section 32. Namely, the mass member 30 is pivotable about the mass member pivot point 31 in such a manner that the mass section 33 angularly moves in the up-down direction in a region over the rear end region 20*b* of the key 20 with the shank section 32 functioning as a pivot arm.

On the rear wall 14*b* of the support section 14 are provided an upper mass member's pivoting movement limiting stopper (hereinafter "upper mass member limit stopper") 34 for limiting pivoting movement, in the clockwise direction of FIG. 2, of the mass member 30 and a lower mass member's pivoting movement limiting stopper (hereinafter "lower mass member limit stopper") 35 for limiting pivoting movement, in the counterclockwise direction of FIG. 2, of the mass member 30. The lower mass member limit stopper 35 abuts against the shank section 32 of the mass member 30 angularly moved to a lower limit position, while the upper mass member limit stopper 34 abuts against the shank section 32 of the mass member 30 angularly moved to an upper limit position. With these lower mass member limit stopper 35 and upper mass member limit stopper 34, the mass member 30 is pivotable between a lower limit position where the shank section 32 extends rearwardly and downwardly from the mass member pivot point 31 as shown in FIG. 4A and an upper limit position where the shank section 32 extends rearwardly and substantially horizontally from the mass member pivot point 31 as shown in FIG. 4B. The mass member 30 moves in interlocked relation to movement of the key 20 via a later-described transmission member 46, so that it imparts a reaction force to performance operation of the key 20 in conjunction with the electromagnetic actuator 40.

The electromagnetic actuator (driving force imparting section) 40 for imparting a predetermined driving force to the key 20 and mass member 30 is provided between an upper surface portion of the key 20 located rearwardly of the key pivot point 12 and the shank section 32 of the mass member 30. In the instant embodiment, the electromagnetic actuator 40 is a bi-directionally-driven actuator which includes a fixed coil section 41 comprising two fixed solenoid coils, i.e. projecting coil 41*a* and retracting coil 41*b*, disposed in vertical coaxial alignment with each other, and a single plunger 42 vertically slidably inserted within the projecting coil 41*a* and retracting coil 41*b*. Further, yokes 40*a* and 40*b* are provided around, i.e. surround, the outer peripheries of the projecting coil 41*a* and retracting coil 41*b*, respectively.

Each of the above-mentioned yokes 40*a* and 40*b* is fixed at its rear surface to the front surface of the rear wall 14*b* of the support section 14 via a flat plate 15. Thus, the projecting coil 41*a* and retracting coil 41*b* are fixed to the support section 14 and frame 11 that are fixed component parts. The plunger 42 includes a body portion 42*a* of a columnar shape formed, for example, of a ferromagnetic substance which is reciprocatively slidable in the up-down direction inside the projecting coil 41*a* and retracting coil 41*b*, a first rod 42*b* connected to the upper end of the body portion 42*a*, and a second rod 42*c* connected to the lower end of the body portion 42*a*. The body portion 42*a*, first rod 42*b* and second rod 42*c* are disposed in vertical axial alignment with one another. A flat plate member 43 for mounting thereon a later-described position sensor (operation detection section) 47 is fixed to the upper end of the first rod 42*b*. The plate member 43, which is a relatively light-weight member, includes a horizontal body portion 43*a* fixed to the upper end of the first rod 42*b* and a front wall portion 43*b* extending from the front end of the horizontal body portion 43*a* vertically downward; thus, the plate member 43 has a substantially "L" sectional shape. A support member 44 having a horizontal upper surface is fixed to the upper surface of the horizontal body portion 43*a*. A cylindrical roller 36 is mounted on the lower surface of the shank section 32 opposed to the support member 44. The cylindrical roller 36 has a horizontal axis extending in the key-arranged direction and is placed at its lower surface portion on the upper surface of the support member 44. Further, a cap-shaped cover member 45, having shock absorbing and sliding functions, is fixed to the lower end of the second rod 42*c* and placed at its lower end on a screw 25 that is opposed to the cover member 45.

The above-mentioned plunger 42 (including the body portion 42*a*, first rod 42*b* and second rod 42*c*), plate member 43 and support member 44 together constitute the transmission member 46 for transmitting a load (i.e., load by a mass or inertial load due to pivoting movement) from one of the key 20 and mass member 30 to the other of the key 20 and mass member 30. The transmission member 46 is held sandwiched between the mass member 30 and the key 20 by a load due to the self-weight of the mass member 30.

The electromagnetic actuator 40 can drive the transmission member 46 (i.e., plunger 42) in two directions by the projecting coil 41*a* and retracting coil 41*b* being supplied with driving currents. Namely, as the retracting coil 41*b* is supplied with the driving current, the transmission member 46 moves downward; thus, a downward load is imparted from the transmission member 46 to a portion of the key 20 located rearwardly of the key pivot point 12, so that a load acting on the key 20 in a key releasing direction increases. On the other hand, as the projecting coil 41*a* is supplied with the driving current, the plunger 42 moves up; thus, the load acting downward on the portion of the key 20 located rearwardly of the key pivot point 12 decreases, so that the load acting on the key 20 in the key releasing direction decreases.

Namely, the key 20 is normally biased in the key releasing direction by the load (i.e., load by the mass of the mass member 30) applied thereto via the transmission member 46. The key 20 is caused to pivot in a key depressing direction as the load (reaction force) from the mass member 30 is reduced by the driving force of the electromagnetic actuator 40. In this case, when the key 20 is not being depressed, the load applied, in the key releasing direction, from the mass member 30 is greater than a biasing force, in the key depressing direction, applied by the self-weight of the key 20, and thus, the key 20 is held in a key-released position with the biasing force in the key depressing direction cancelled out. Then, as the load from the mass member 30 is reduced by the driving force of the electromagnetic actuator 40, the biasing force, in the key depressing direction, by the self-weight of the key 20 gradually becomes greater than the load, in the key releasing direction, from the mass member 30, so that the key 20 pivots in the key depressing direction.

While the key 20 and mass member 30 pivot about the respective pivot points 12 and 31, the transmission member 46 (plunger 42) linearly moves in its axial direction inside the projecting coil 41*a* and retracting coil 41*b*. Thus, as the key 20, mass member 30 and transmission member 46 move integrally with one another, the upper end of the vertically-linearly moving transmission member 46 slides on and along the outer peripheral surface of the roller 36 angularly moving in response to the vertical pivoting movement of the mass member 30, in a first abutment area 48 where the upper end of the transmission member 46 (i.e., upper surface of the support member 44) and the roller 36 of the mass member 30 is held in abutment with each other. Similarly, in a second abutment area 49 where the lower end of the transmission member 46 is held in abutment with the screw 25 of the key 20, the lower end of the linearly-vertically moving transmission member 46 slides on and along the upper surface of the screw 25 that angularly moves in response to the pivoting movement of the key 20.

As noted above, the key 20 and mass member 30 and the transmission member 46 perform different movement, i.e. pivoting movement and linear movement. Thus, in the first and second abutment areas 48 and 49 where the key 20 and mass member 30 and the transmission member 46 abut against with each other, sliding movement necessarily takes place as the key 20 and mass member 30 move. Consequently, if the mass member 30 and key 20 and the transmission member 46 are not detachably connected with each other in the first and second abutment areas 48 and 49 as in the conventionally-known keyboard apparatus, then great binding forces would occur due to increase of normal forces and friction regions and the like, which would become a factor that impedes smooth movement of the key and mass member 30.

Therefore, in the instant embodiment of the keyboard apparatus 10, the transmission member 46 is held in detachable abutment with the key 20 and mass member 30 in such a manner that it can be disengaged or detached from the key 20 and mass member 30 depending on operating conditions of the key 20 and mass member 30, for the following reason. Namely, the transmission member 46 normally moves integrally with the key 20 and mass member 30 with its opposite ends (i.e., upper and lower ends) held in abutment with the key 20 and mass member 30. But, when the key 20 has been depressed rapidly with a great depressing force or depressed or released at an extremely high speed, and if acceleration produced in the transmission member 46 and acceleration produced in the key 20 or mass member 30 differ from each other, the above-mentioned detachable abutment allows the transmission member 46 to sometimes instantaneously disengage from the key 20 and mass member 30. Because the transmission member 46 is held in detachable abutment with the key 20 and mass member 30 in such a manner that it can be disengaged or detached from any of the key 20 and mass member 30 depending on the operating conditions of the key 20 and mass member 30 as noted above, it is possible to prevent unnecessary binding forces from occurring in the first and second abutment areas 48 and 49. As a result, the instant embodiment of the keyboard apparatus 10 can achieve smooth movement of the key 20 and mass member 30 and hence achieve force sense control with good responsiveness.

If the transmission member 46 are not detachably connected with the key 20 and mass member 30 in the first and second abutment areas 48 by link coupling, the key 20 and mass member 30 and the transmission member 46 always move integrally with each other, which is equivalent to a case where the inertial mass of the transmission member 46 has increased by an amount corresponding to the inertial mass of the key 20 and mass member 30. Thus, when the transmission member 46 is to be driven by the electromagnetic actuator 40, the transmission member 46 would move only with poor responsiveness. In order to enhance the operational responsiveness of the transmission member 46, the electromagnetic actuator 40 would require increased driving energy (such as increased driving voltage). However, the instant embodiment of the keyboard apparatus 10, where the transmission member 46 is provided in detachable abutment with both of the key 20 and mass member 30 such that the transmission member 46 can be disengaged or detached from any of the key 20 and mass member 30 depending on operating conditions of the key 20 and mass member 30, can prevent increase of the inertial mass of the transmission member 46. Therefore, when the transmission member 46 is to be driven by the electromagnetic actuator 46, it is possible to not only secure good operational responsiveness of the transmission member 46, but also save necessary energy for driving the transmission member 46.

With the transmission member 46 provided in detachable abutment with the key 20 and mass member 30 as set forth above, the instant embodiment of the keyboard apparatus 10 can avoid the aforementioned problem and achieve smooth movement of the key 20.

Further, in the keyboard apparatus 10, the position sensor (operation detection section) 47 is provided for detecting a position of the transmission member 46 (plunger 42). The position sensor 47, as shown in FIG. 3, includes a light receiving section 47*a* provided on the front surfaces of the yokes 40*a* and 40*b*, and a reflection surface 47*b* provided on a position, opposed to the light receiving section 47*a*, of the front wall portion 43*b* of the plate member 43. Namely, the position sensor 47 is a reflection type sensor constructed so that the light receiving section 47*a* receives reflected light from the reflection surface 47*b*. The reflection surface 47*b* is constructed in such a manner that reflected light amounts from different vertical positions of the reflection surface 47*b* vary continuously. Thus, a position of the transmission member 46 can be identified on the basis of an output signal from the light receiving section 47*a*.

As long as the position sensor 47 can detect a position of the transmission member 46 (plunger 42), it may be of any other type than the above-mentioned reflection type, such as another optical type or non-optical type. Alternatively, the position sensor 47 may be replaced with a position detecting switch or the like. Further, whereas the instant embodiment has been described above as including the position sensor 47 as one example of the operation detection section for detecting operation of the transmission member 46, the embodiment may include, in addition to the position sensor 47, a velocity sensor or an acceleration sensor for detecting an operating speed or velocity or acceleration of the transmission member 46, or a combination thereof.

Further, the instant embodiment of the keyboard apparatus 10 is constructed to detect operation (displacement, velocity, etc.) of the transmission member 46 and perform driving control on the electromagnetic actuator 40 on the basis of the detection of the operation of the transmission member 46. In addition, the instant embodiment of the keyboard apparatus 10 may include an operation detection section for detecting operation (position, velocity, acceleration, etc.) of at least any one of the key 20 and mass member 30 and perform driving control on the electromagnetic actuator 40 on the basis of the detection of the operation of any one of the key 20 and mass member 30. In an alternative, the instant embodiment of the keyboard apparatus 10 may include one or more operation detection sections for detecting operation of at least one of the transmission member 46, key 20 and mass member 30, so that any of the operation detection sections can be used for driving control on the electromagnetic actuator 40 while the remaining of the operation detection sections can be used for tone generation control on an electronic tone generator. Of course, one operation detection section may be used for both the driving control on the electromagnetic actuator 40 and the tone generation control on the electronic tone generator.

As set forth above, the instant embodiment of the keyboard apparatus 10 includes the mass member 30 provided for pivoting movement in the region over the key 20, and the electromagnetic actuator 40 and transmission member 46 provided between the key 20 and the mass member 30 for imparting a generated driving force to the key 20 and mass member 30. The electromagnetic actuator 40 and transmission member 46 are disposed between a portion of the key 20 located on an opposite side from the key depression section 20*c* with respect to (i.e., as viewed from) the key pivot point 12. Further, the electromagnetic actuator 40 is a single device that can be actuated to drive the transmission member 46 in two directions, i.e. a direction toward the mass member 30 and a direction toward the key 20.

The following describe the main control section 50 shown in FIG. 1. The main control section 50 includes a CPU 51, a ROM 52, a RAM 53 and a flash memory (EEPROM) 54. A timer 55 is connected to the CPU 51. The CPU 51 controls the entire electronic keyboard instrument 1 including the keyboard apparatus 10. The ROM 52 and flash memory 54 have stored therein not only control programs to be executed by the CPU 51 and various table data, but also a later-described force sense imparting table 80 and automatic performance data 85. The RAM 53 temporarily stores various information, such as performance data and text data, various flags, buffer data and results of arithmetic operations. The timer 55 counts various times, such as times to signal interrupt timing for timer interrupt processes.

The instant embodiment of the keyboard apparatus 10 further includes a setting operation section 61, a display device 63, a sound output section 65, an external storage device 66, an HDD 67, a communication interface 68, a MIDI interface 69, etc. An external device 71 is connectable to the communication interface 68, and a MIDI device 72 is connectable to the MIDI interface 69. Further, the communication interface 68 permits communication with an external server apparatus 74 via a communication network 73, such as the Internet. The setting operation section 61 includes various switches (not shown) operable by the human player to enter setting operation information, and a signal generated in response to operation of any of the switches is supplied to the CPU 51. The external storage device 66 and HDD 67 are provided for storing various application programs, including the above-mentioned control programs, and various music piece data. The display device 63 is connected to the bus 51 via a display control circuit 62, and the sound output section 65 is connected to the bus 51 via a tone generator circuit 64.

Figure 5:
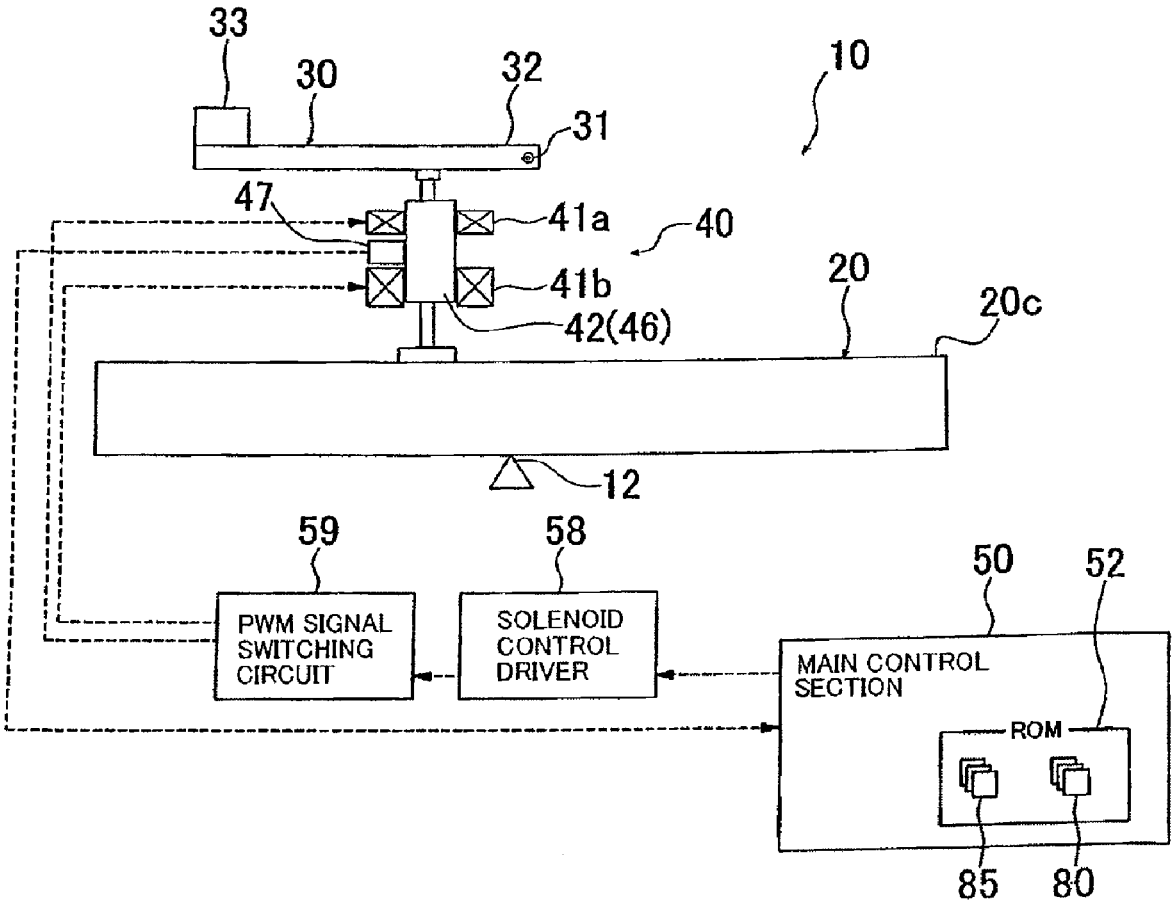
FIG. 5 is a block diagram showing a general construction of the keyboard apparatus including a drive control circuit.

FIG. 5 is a block diagram showing a general construction of the keyboard apparatus 10 including a driving control circuit for controlling driving of the key 20. As shown in FIG. 5, the driving control circuit of the keyboard apparatus 10 includes the main control section 50, and a control driver 58 and PWM switching circuit 59 for outputting a driving PWM (Pulse Width Modulation) signal to the projecting coil 41*a* or retracting coil 41*b* of the actuator 40 in accordance with an instruction given from the control section 50. The main control section 50, which is constructed in the manner as shown in FIG. 1, includes the ROM 52 having stored therein the force sense imparting table 80 and automatic performance data 85. Position information of the plunger 42 detected by from the position sensor 47 is supplied to the control driver 58 and PWM switching circuit 59. Then, the control driver 58 and PWM switching circuit 59 supply a driving current to the projecting coil 41*a* or retracting coil 41*b* of the actuator 40 on the basis of the control signal given from the control section 50.

Figure 6:
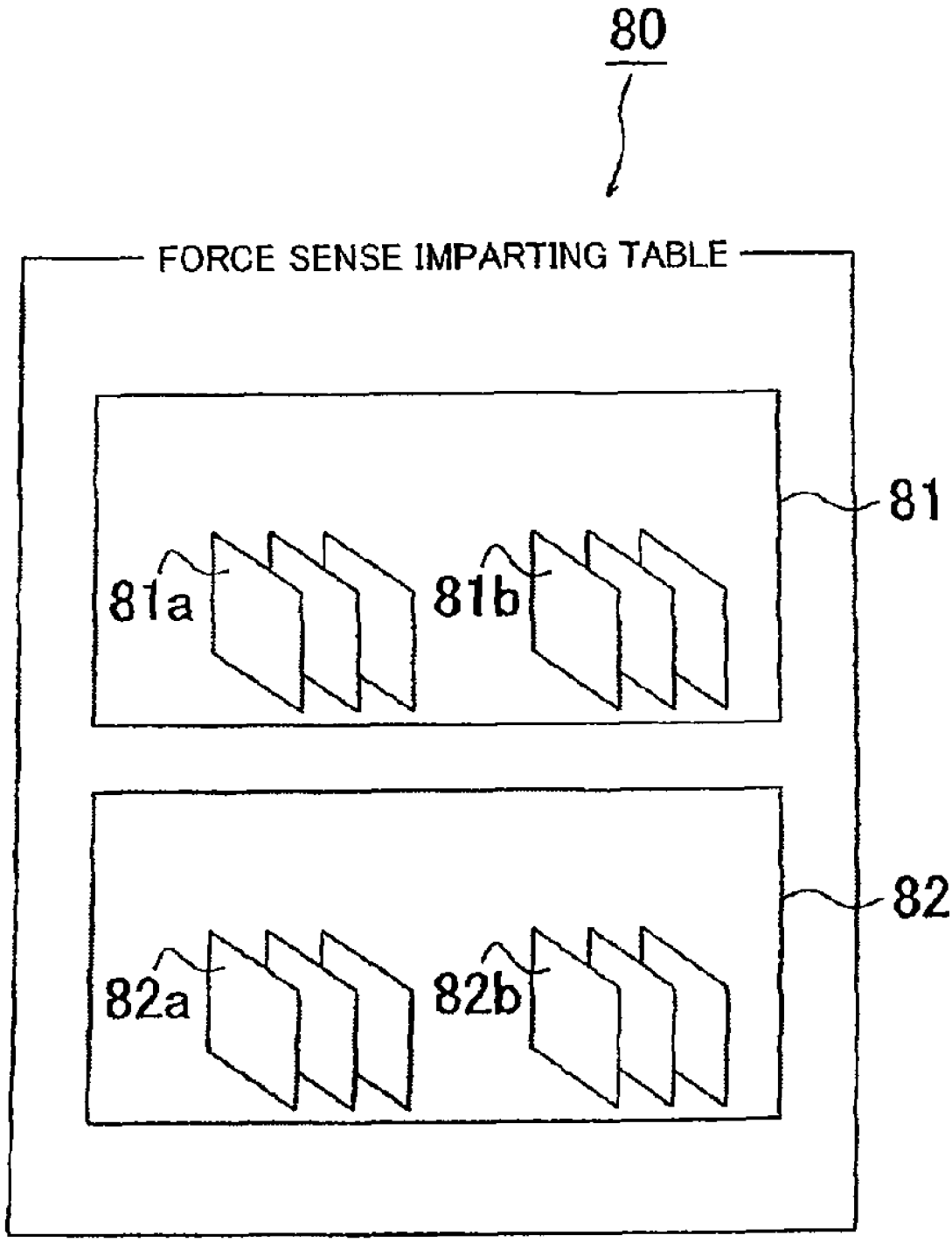
FIG. 6 is a diagram showing an example configuration of a force sense imparting table.

FIG. 6 is a diagram showing an example configuration of the force sense imparting table 80 stored in the ROM 52. The force sense imparting table 80 is a table containing patterns of driving forces to be generated by the electromagnetic actuator 40. Further, the force sense imparting table 80 includes a key depressing table 81 and a key releasing table 82. These key depressing table 81 and key releasing table 82 include reaction force pattern tables 81*a* and 82*a* and instruction value tables 81*b* and 82*b*, respectively. The reaction force pattern tables 81*a* and 82*a* are tables for referencing output values corresponding to signals indicative of detection values of the position sensor 47 (or values of velocity and acceleration calculated on the basis of the detection values). Further, the instruction value tables 81*b* and 82*b* are tables for referencing instruction values for causing the control driver 58 and PWM switching circuit 59 to generate the above-mentioned output values.

The following describe behavior of the keyboard apparatus 10 constructed in the aforementioned manner. When no key depressing force is acting on the key 20, the key 20 is held in the non-depressed position shown in FIG. 4A with the lower surface of the rear end region 20*b* of the key 20 held abutting against the upper key limit stopper 21 and the key depression section 20*c*, located in the front end region 20*a*, held in its uppermost position, because of intensity relationship between the biasing force, in the key depressing direction, produced by balance between masses (self-weights) before and behind the key pivot point 12 and the load applied from the mass member 30 to the key 20 via the transmission member 46. At that time, the shank section 32 of the mass member 30 is in its lower limit position abutting against the lower mass member limit stopper 35. Once the key 20 in the non-depressed position is depressed, the key 20 pivots about the key pivot point 12 in the key depressing direction while pushing upward the mass member 30 via the transmission member 46. In this manner, the key 20 pivots in the clockwise direction of FIG. 4A until the lower surface of the front end region 20*a* abuts against the lower key limit stopper 22, so that the key 20 takes the depressed position shown in FIG. 4B. When the key 20 is in the depressed position, the shank section 32 of the mass member 30, pushed upward by the key 20 via the transmission member 46, is in its upper limit position abutting against the upper mass member limit stopper 34. Then, once the key depressing force to the key 20 is removed, a load is applied from the mass member 30, pivoting in the counterclockwise direction of FIG. 4B due to its self-weight, to the key 20 via the transmission member 46, so that the key 20 returns to the non-depressed position because of both the applied load and the self-weight balance.

By driving the transmission member 46 in the two directions by means of the electromagnetic actuator 40 when the key 20 moves using the inertial load of the mass member 30, the instant embodiment can assist or reduce the biasing force applied from the mass member 30 to the key 20. Thus, by the main control section 50 controlling the driving of the electromagnetic actuator 40, the instant embodiment can perform force sense control on a reaction force to be imparted key depression operation.

The following describe in greater detail the force sense control on key depression operation. In order to replicate or reproduce a particular key touch feeling (sense of resistance) felt through a finger on the basis of operation of an action mechanism of an acoustic piano, the instant embodiment of the keyboard apparatus 10 is constructed to impart a reaction force characteristic, corresponding to the key touch feeling of the acoustic piano, to the key 20 by driving the plunger 42 via the electromagnetic actuator 40 during a performance of the electronic keyboard instrument 1. The above-mentioned reaction force characteristic changes from moment to moment in response to a changing position of the key 20. Thus, in the aforementioned force sense control, a driving force is imparted on the basis of position information of the transmission member 46 detected by the position sensor 47. Namely, first, detection data generated by the position sensor 47 is output to the main control section 50. Then, the main control section 50 issues an instruction to the control driver 58 and PWM switching circuit 59 with reference to position information of the plunger 42 based on the detection data of the position sensor 47 and the force sense imparting table 80 stored in the ROM 52. Then, the control driver 58 and PWM switching circuit 59 supplies a driving current to the projecting coil 41*a* or retracting coil 41*b* on the basis of the instruction from the main control section 50. Thus, by driving of the projecting coil 41*a* or retracting coil 41*b*, a driving force is imparted to the transmission member 46 such that the transmission member 46 is driven toward the mass member 30 or the key 20. Whereas the instant embodiment has been described above in relation to the case where a driving force to be supplied by the electromagnetic actuator 40 is determined with reference to the force sense imparting table 80, such a driving force to be supplied by the electromagnetic actuator 40 may be determined through arithmetic operations based on the position information of the transmission member 46 detected by the position sensor 47.

Figure 7A:
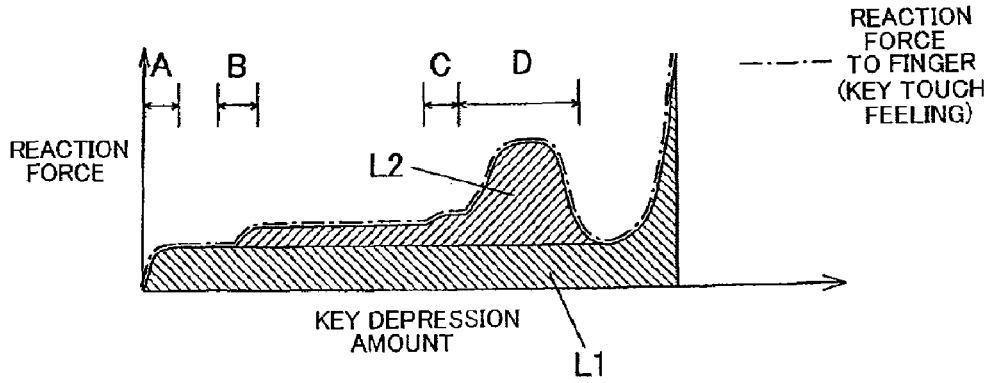
FIGS. 7A to 7D are graphs showing relationship between a displacement (depression amount) of the key and a reaction force (load) in a case where force sense control has been performed.
Figure 7B:
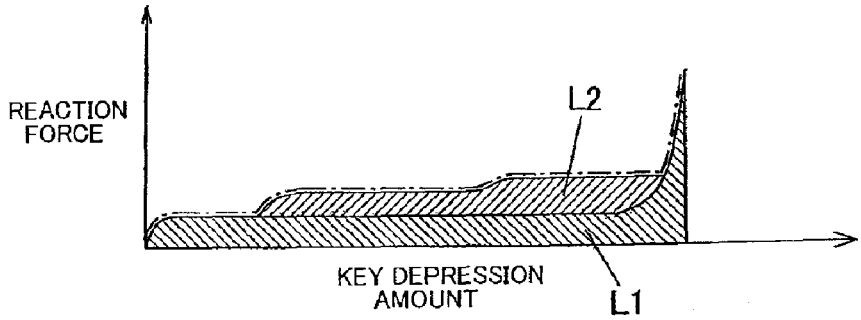
Figure 7C:
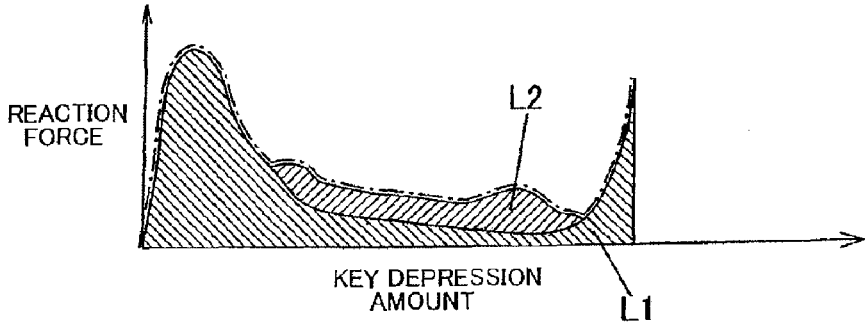
Figure 7D:
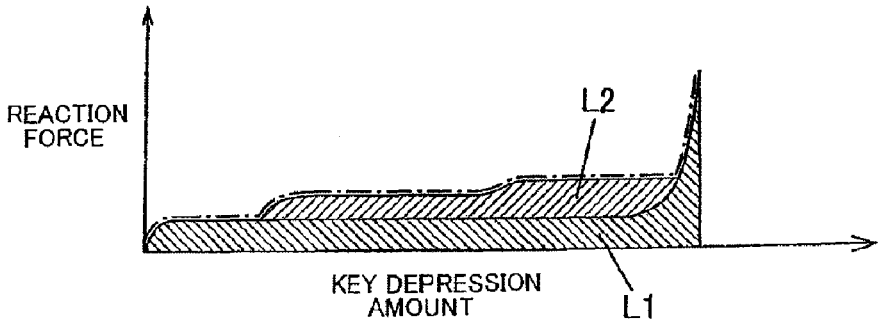

FIGS. 7A to 7D are graphs showing relationship between a displacement (depression amount) of the key 20 and a reaction force applied from the key 20 to a human player's finger depressing the key 20 in the case where the force sense control has been performed via the electromagnetic actuator 40, of which FIGS. 7A and 7B show distributions of reaction forces when the key 20 has been depressed and released relatively slowly while FIGS. 7C and 7D show distributions of reaction forces when the key 20 has been depressed and released relatively quickly.

With the force sense control performed on the key 20 in the instant embodiment of the keyboard apparatus 10, the reaction force applied from the key 20 to the human player's finger depressing the key 20 is a sum or of a reaction force L1 caused by the mass or inertial load of the mass member 30 acting on the key 20 and a reaction force L2 imparted to the key 20 by the electromagnetic actuator 40 (see one-dot-dash line in FIGS. 7A to 7D). The distribution of reaction forces applied to the human player's finger is results of cooperation between the reaction forces F1 of the mass member 30 and the reaction forces L2 imparted by the electromagnetic actuator 40 and thus can be said to be a reproduction of a distribution of reaction forces in an acoustic piano.

The following describe in greater detail the distributions of reaction forces to operation of the key 20. First, the distribution of reaction forces of FIG. 7A when the key 20 has been depressed relatively slowly is described. In this case, the reaction forces applied to the human player's finger depressing the key 20 exhibit a distribution starting at an initial value (zero load) corresponding to a zero key depression amount and including changes in four regions A, B, C and D.

Region A in FIG. 7A represents a reaction force distribution caused by static loads when the key 20 and mass member 30 start to be lifted from their rest states at an initial stage of depression of the key 20. At the initial stage of depression of the key 20, the plunger 42 has not yet been driven by the electromagnetic actuator 40, and only a reaction force from the mass member 30 is acting on the key 20. Although this region A is caused by the static loads of the key 20 and mass member 30 in their rest states, a similar distribution also appears in reaction force characteristics at an initial stage of depression of a key in an acoustic piano because of lifting of the key and corresponding hammer. Region B in FIG. 7A represents a reaction force distribution when driving, by the electromagnetic actuator 40, of the plunger 42 has been started, and in this region B are replicated or reproduced reaction forces applied to a key in an acoustic piano when the damper has started to be lifted by the key via an action mechanism.

Region C in FIG. 7A represents a distribution of reaction forces created by the driving of the electromagnetic actuator 40, where the reaction forces present an increase amount slightly smaller than that in region B. In this region C are replicated or reproduced reaction forces imparted to a key in an acoustic piano through operation of various components of an action mechanism during depression of the key. Further, region D represents a mountain-shaped distribution of reaction forces, which involves rapid and great increase and decrease of reaction forces created through the driving of the actuator 40. In this region D is reproduced a rapid change of a load applied to a key in an acoustic piano by a jack escaping out of fitting engagement from a hammer roller. Note that the reaction force L1 applied from the mass member 30 to the key 20 rapidly increases again in a region following region D; this rapid increase is due to a reaction force which the mass member 30 receives from the upper mass member limit stopper 34 or which the key 20 receives from the lower key limit stopper 22.

Further, the distribution of reaction forces responsive to relatively slow release operation of the key 20 shown in FIG. 7B is generally similar to the distribution of reaction forces shown in FIG. 7A, except that there is no reaction force change corresponding to a jack escaping load in region D of FIG. 7A. In this case too, a distribution of reaction forces responsive to depression operation of a key in an acoustic piano is reproduced. Furthermore, the distribution of reaction forces responsive to relatively rapid depression of the key 20 shown in FIG. 7C is a mountain-shaped distribution involving rapid and great increase and decrease of the reaction force L1 caused by the mass member 30 at an initial stage of the key depression. This is because of great static loads caused when the key 20 and mass member 30 are rapidly moved from their rest states. With the relatively quick depression of the key 20, there appears almost no reaction force change which corresponds to a jack escaping load in an acoustic piano. The aforementioned reaction force distributions are generally similar to those occurring in actual key operation of an acoustic piano. With the relatively rapid depression of the key 20, as shown in FIG. 7D, the reaction force F1 applied from the mass member 30 remains substantially constant at small values, and reaction forces caused in an acoustic piano by various components of an action mechanism returning to their respective initial positions are reproduced as the reaction force L2 by the electromagnetic actuator 40. Consequently, the reaction forces in FIG. 7D present a distribution approximate to the distribution of reaction forces responsive to the relatively slow release operation of the key 20 shown in FIG. 7B.

Thus, with the instant embodiment of the keyboard apparatus 10, a distribution of reaction forces applied to a human player's finger in response to depression of a key in an acoustic piano including a complicated action mechanism can be faithfully reproduced by a combination of the reaction force L1 by the mass member 30 and the reaction force L2 created by the electromagnetic actuator 40.

Further, the instant embodiment of the keyboard apparatus 10 can reduce a force acting on the key 20 in the key releasing direction, by the electromagnetic actuator 40 driving the transmission member 46 in a direction (in this case, upward direction) opposite from the direction (in this case, downward direction) where a reaction force is applied to the key 20. Thus, the key 20 pivots by its own weight in the key depression direction by the electromagnetic actuator 40 driving the transmission member 46 upward when no operation is being performed by the human player on the key 20 resting in the non-depressed position. Utilizing such action, the keyboard apparatus 10 can automatically move the key 20 even without key depression operation by the human player. As a result, the electronic keyboard instrument 1 can execute an automatic performance involving automatic (i.e., unmanned) operation of the keys 20.

In such an automatic performance, instructions pertaining to the automatic performance are issued from the main control section 50 to the control driver 58 and PWM switching circuit 59, on the basis of the automatic performance data 85 stored in the ROM 52. On the basis of the instructions, the control driver 58 and PWM switching circuit 59 supply a driving current to the projecting coil 41*a*. Thus, the transmission member 46 is moved upward (i.e., toward the mass member 30) through the driving of the projecting coil 41*a*, so that the key 20 pivots to the depressed position. Once the supply of the driving current to the projecting coil 41*a* is terminated, the plunger 42 moves downward (toward the key 20) by the load from the mass member 30. Thus, a load is applied from the plunger 42 to the key 20 in the key releasing direction, so that the key 20 pivots to the released position. Such movement of the key 20 is performed at predetermined timing according to operation information of the keys 20 based on the automatic performance data, so that the keys 20 can perform motions conforming to predetermined performance tones.

As set forth above, the instant embodiment of the keyboard apparatus 10 includes the transmission member 46 provided in abutment with both of the key 20 and mass member 30 to transmit a load from one of the key 20 and mass member 30 to the other, and the electromagnetic actuator 40 that drives the transmission member 46 to act on at least one of the key 20 and mass member 30. The electromagnetic actuator 40 is located between the key 20 and the mass member 30, and a driving force generated by the electromagnetic actuator 40 can be supplied to both of the key 20 and mass member 30. Thus, a same operating system can be shared between the mass member 30 acting on the key 20 and the electromagnetic actuator 40 (i.e., the operating system of the mass member 30 and the operating system of the electromagnetic actuator 40 can be constructed as a single common operating system), so that the load acting from one of the key 20 and mass member 30 to the other can be appropriately controlled by the electromagnetic actuator 40 and the force sense control and driving control can be performed appropriately on the key 20.

Further, because the transmission member 46 is held in detachable abutment with the key 20 and mass member 30 in such a manner that it can be disengaged or detached from any of the key 20 and mass member 30 depending on operating conditions of the key 20 and mass member 30 as noted above, it is possible to prevent unnecessary binding forces from occurring in the abutment areas where the transmission member 46 and the key 20 and mass member 30 abut against each other. As a result, the instant embodiment of the keyboard apparatus 10 can achieve smooth movement of the key 20 and mass member 30 and hence achieve force sense control with good responsiveness.

Furthermore, the key 20 provided in the keyboard apparatus 10 is a component part similar in construction and operation to a key of an acoustic piano, and the mass member 30 is a component part similar in construction and operation to a hammer of an acoustic piano. Using such component parts similar to a key and hammer of an acoustic piano, the keyboard apparatus 10 allows the static load and dynamic load of the key 20 to be approximate to those of an acoustic piano.

Furthermore, in the keyboard apparatus 10, the mass member 30 is pivotably supported over the key 20, and the electromagnetic actuator 40 and transmission member 46 are disposed between a portion of the key 20 located opposite from the key depression section 20*c* with respect to (i.e., as viewed from) the key pivot point 12 and the mass member 30. Such a construction is equivalent to a construction where a wippen assembly disposed between a key and a hammer in an action mechanism of an acoustic piano is replaced with the electromagnetic actuator 40 and transmission member 46. Thus, by the electromagnetic actuator 40 and transmission member 46 performing the function of the wippen assembly of an acoustic piano, the instant embodiment of the keyboard apparatus 10 can achieve a key touch feeling extremely approximate to that of an acoustic piano with minimum necessary structural arrangements and control. In addition, the instant embodiment of the keyboard apparatus 10 can perform an automatic performance involving automatic operation of the keys 20.

However, the key 20 and mass member 30 need not necessarily be constructed similarly to a key and mass member of an acoustic piano. In the case where the key 20 and mass member 30 are constructed differently from a key and mass member of an acoustic piano, influences which the key 20 has on a key touch feeling can be covered by controlling the driving force to be imparted to the key 20 and mass member 30 by means of the electromagnetic actuator 40.

According to the first aspect of the present invention, the above-described first embodiment is characterized in that the transmission member 46 is provided in detachable abutment with the key 20 and mass member 30 such that the transmission member 46 can be disengaged from detached from any of the key 20 and mass member 30 depending on operating conditions of the key 20 and mass member 30. However, according to the second embodiment of the invention, the transmission member 46 need not necessarily be disengageable or detachable from the key 20 or mass member 30, and the transmission member 46 may be non-detachably coupled (e.g., by link coupling) with the key 20 or mass member 30 as long as a driving force can be transmitted from the transmission member 46 to the key 20 or mass member 30.

Note that the key 20 may be pivoted in the key releasing direction by the electromagnetic actuator 40 driving the key 20 in the key releasing direction (i.e., by the retracting coil 41*b* driving the plunger 42 downward), in addition to terminating the supply of the driving current to the projecting coil 41*a* and thereby causing the plunger 42 to move downward (toward the key 20) by the load from the mass member 30 as noted above. Namely, when the key 20 is to be pivoted in the key releasing direction, a driving force in the key releasing direction is imparted to the key 20 by the electromagnetic actuator 40, in addition to a reaction force imparted from the mass member 30 to the key 20. In this way, the instant embodiment of the keyboard apparatus 10 can enhance operational responsiveness and thereby achieve an improved operational appearance of the key 20 and enhanced quality of an automatic performance.

Further, for automatic movement or operation of the key 20, the operating velocity, in the depressing and releasing directions, of the key 20 may be controlled through bi-directional driving control performed via the electromagnetic actuator 40 on the basis of the automatic performance data 85. In this manner, the driving by the electromagnetic actuator 40 is controlled in the two directions on the basis of the automatic performance data 85, so that the moving velocity of the key 20 responsive to depression/release operation can be adjusted to a desired velocity. As a result, the instant embodiment of the keyboard apparatus 10 can visually reproduce rapid and slow key depression and release operation and improve quality of an automatic performance.

As set forth above, the instant embodiment of the keyboard apparatus 10 includes not only the mass member 30 that normally biases the key 20 in the releasing direction to thereby impart a reaction force to performance operation of the key 20, but also the electromagnetic actuator 40 capable of imparting a driving force to the key 20. By the provision of the mass member 30, the instant embodiment of the keyboard apparatus 10 can more faithfully reproduce an inertial mass feeling characteristic of behavior of a key in a natural keyboard instrument, such as an acoustic piano, than the conventionally-known keyboard apparatus provided with a spring. Further, the instant embodiment of the keyboard apparatus 10 can also appropriately reproduce an operational feeling at the start of depression of a key in an acoustic piano where movement of the key has to be started against the static load of the corresponding hammer.

[Second Embodiment]

Next, a description will be given about a second embodiment of the keyboard apparatus of the present invention. Similar elements to those in the first embodiment are indicated by the same reference numerals as used for the first embodiment and will not be described here to avoid unnecessary duplication. Namely, elements not described in the following description are similar to those in the first embodiment; the same can be said for the third and succeeding embodiments.

Figure 8:
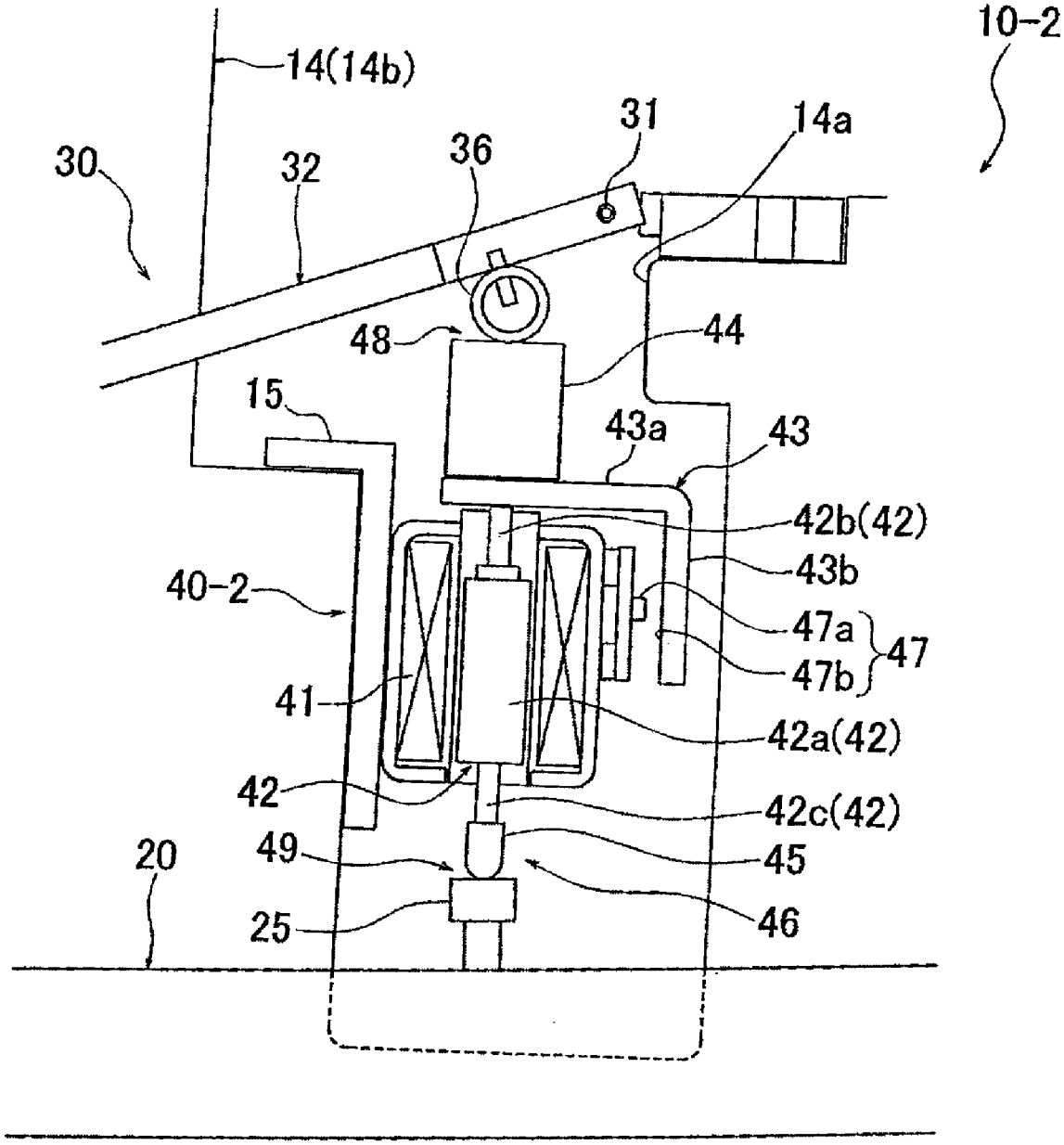
FIG. 8 is a view showing a construction of a second embodiment of the keyboard apparatus of the present invention.

FIG. 8 is a view showing a construction of the second embodiment of the keyboard apparatus 10-2, which includes a uni-directionally driven electromagnetic actuator 40-2 in place of the bi-directionally driven electromagnetic actuator 40 provided in the first embodiment of the keyboard apparatus 10. In other structural respects, the second embodiment of the keyboard apparatus 10-2 is similar to the first embodiment of the keyboard apparatus 10. More specifically, the uni-directionally driven electromagnetic actuator 40-2 includes a single coil 41 and a plunger 42 provided inside the coil 41, and it is constructed to move the plunger 42 only in a downward direction (i.e., toward the key 20) through driving of the coil 41. Further, although not particularly shown, a drive control circuit in the second embodiment of the keyboard apparatus 10-2 has a construction for controlling the driving operation of the electromagnetic actuator 40-2 having the single coil 41.

By the electromagnetic actuator 40-2 driving the transmission member 46 downwardly toward the key 20, a combination of a reaction force based on a mass or inertial load of the mass member 30 acting on the key 20 and a reaction force imparted to the key 20 by the actuator 40 becomes a reaction force applied to a finger of the human player performing depression operation of the key 20. Thus, the second embodiment of the keyboard apparatus 10-2 can create distributions of reaction forces similar to those of FIG. 7 created by the first embodiment and can perform force sense control on performance operation of the key 20.

The second embodiment of the keyboard apparatus 10-2, provided with the uni-directionally driven electromagnetic actuator 40-2, can be simplified in construction and can facilitate the driving control of the electromagnetic actuator 40-2 as compared to the first embodiment. Thus, the second embodiment of the keyboard apparatus 10-2 is suited for application to electronic keyboard instruments of simpler construction and inexpensive electronic keyboard instruments.

[Third Embodiment]

Figure 9:
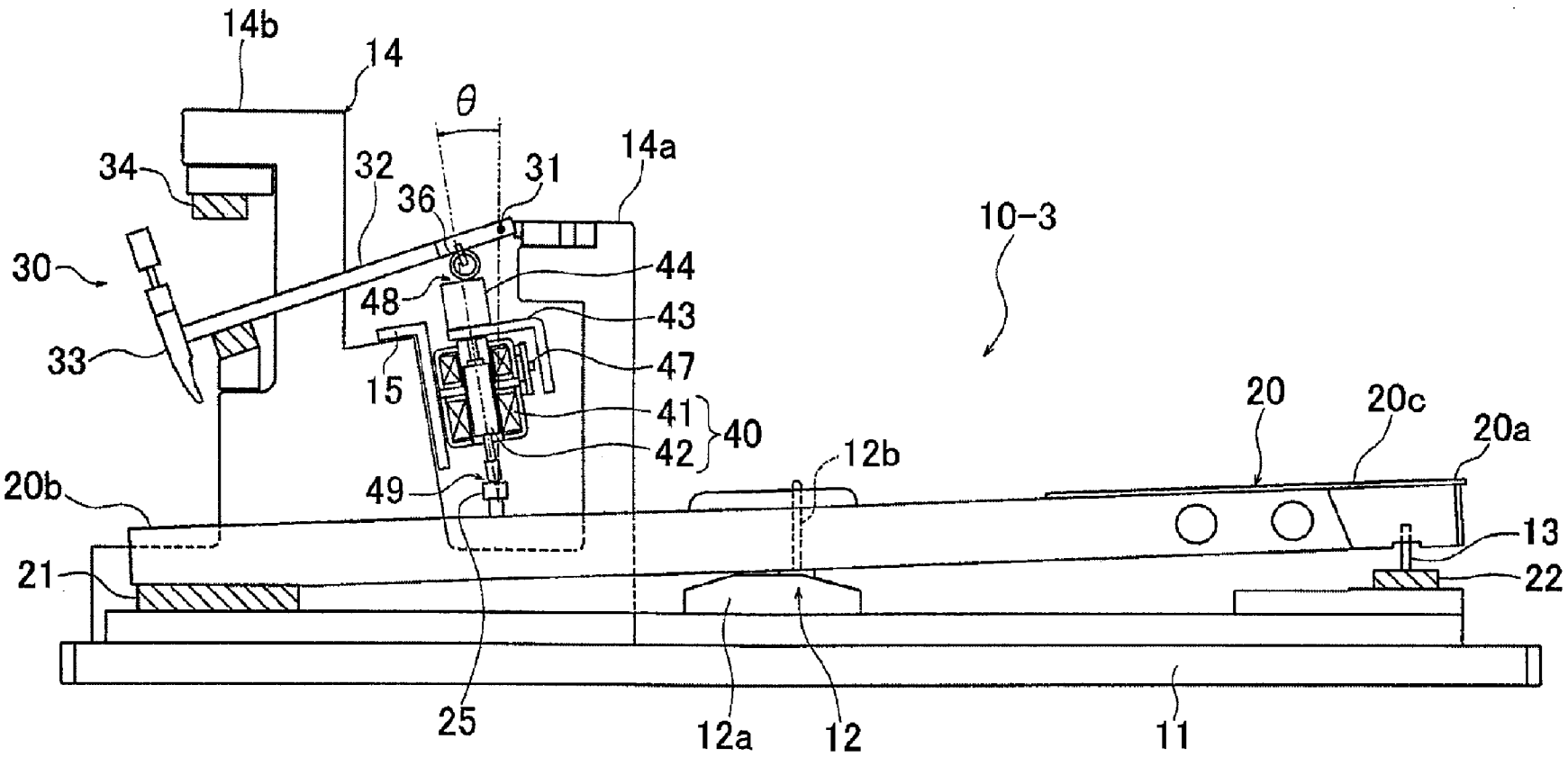
FIG. 9 is a view showing a construction of a third embodiment of the keyboard apparatus of the present invention.

Next, a description will be given about a third embodiment of the keyboard apparatus of the present invention. FIG. 9 is a view showing a construction of the third embodiment of the keyboard apparatus 10-3. Whereas the electromagnetic actuator 40 in the first embodiment of the keyboard apparatus 10 is provided in such a manner that the respective axes of the projecting coil 41*a*, retracting coil 41*b* and plunger 42 are oriented in the vertical direction, the electromagnetic actuator 40-3 in the third embodiment of the keyboard apparatus 10-3 is provided in such a manner that the respective axes of the projecting coil 41*a*, retracting coil 41*b* and plunger 42 are slightly inclined with respect to the vertical direction. In other structural respects, the third embodiment of the keyboard apparatus 10-3 is similar to the first embodiment of the keyboard apparatus 10.

Specifically, the rear wall 14*b* of the support section 14 supporting the electromagnetic actuator 40-3 is inclined by a predetermined angle θ in the front-rear direction with respect to the vertical direction so that the upper side of the rear wall 14*b* is located rearwardly of the lower side of the rear wall 14*b*. Thus, the axes of the projecting coil 41*a* and retracting coil 41*b* fixed to the front surface of the rear wall 14*b* and the plunger 42 inserted within the coils 14*a* and 14*b* are inclined by the same predetermined angle θ in the front-rear direction. Consequently, a first abutting angle at which the transmission member 46 abuts against the roller 36 of the mass member 30 in the first abutment area 48 and a second abutting angle at which the key 20 abuts against the screw 25 in the second abutment area 49 are different from those in the first embodiment of the keyboard apparatus 10. More specifically, these abutting angles in the third embodiment of the keyboard apparatus 10-3 are set so as to minimize an amount of contacting-sliding movement between the upper end of the transmission member 46 (upper surface of the support member 44) linearly moving along a direction of the inclined axis and the roller 36 of the vertically-pivoting mass member 30 and an amount of contacting-sliding movement between the lower end of the linearly-moving transmission member 46 and the screw 25 of the vertically-pivoting key 20.

Namely, in the third embodiment of the keyboard apparatus 10-3, the abutting angles between the transmission member 46 and the key and between the transmission member 46 and the mass member 30 are set so as to minimize the amounts of the contacting-sliding movement of the transmission member 46 relative to the key 20 and the mass member 30. In this manner, it is possible to minimize frictional force produced in the first and second abutment areas 48 and 49 due to the sliding movement as the mass member 39 and the key 20 move, so that smooth movement of the key 20 and the mass member 30 is permitted. As a result, the third embodiment of the keyboard apparatus 10-3 can create a key touch feeling more approximate to that of a natural keyboard instrument, such as an acoustic piano.

[Fourth Embodiment]

Figure 10:
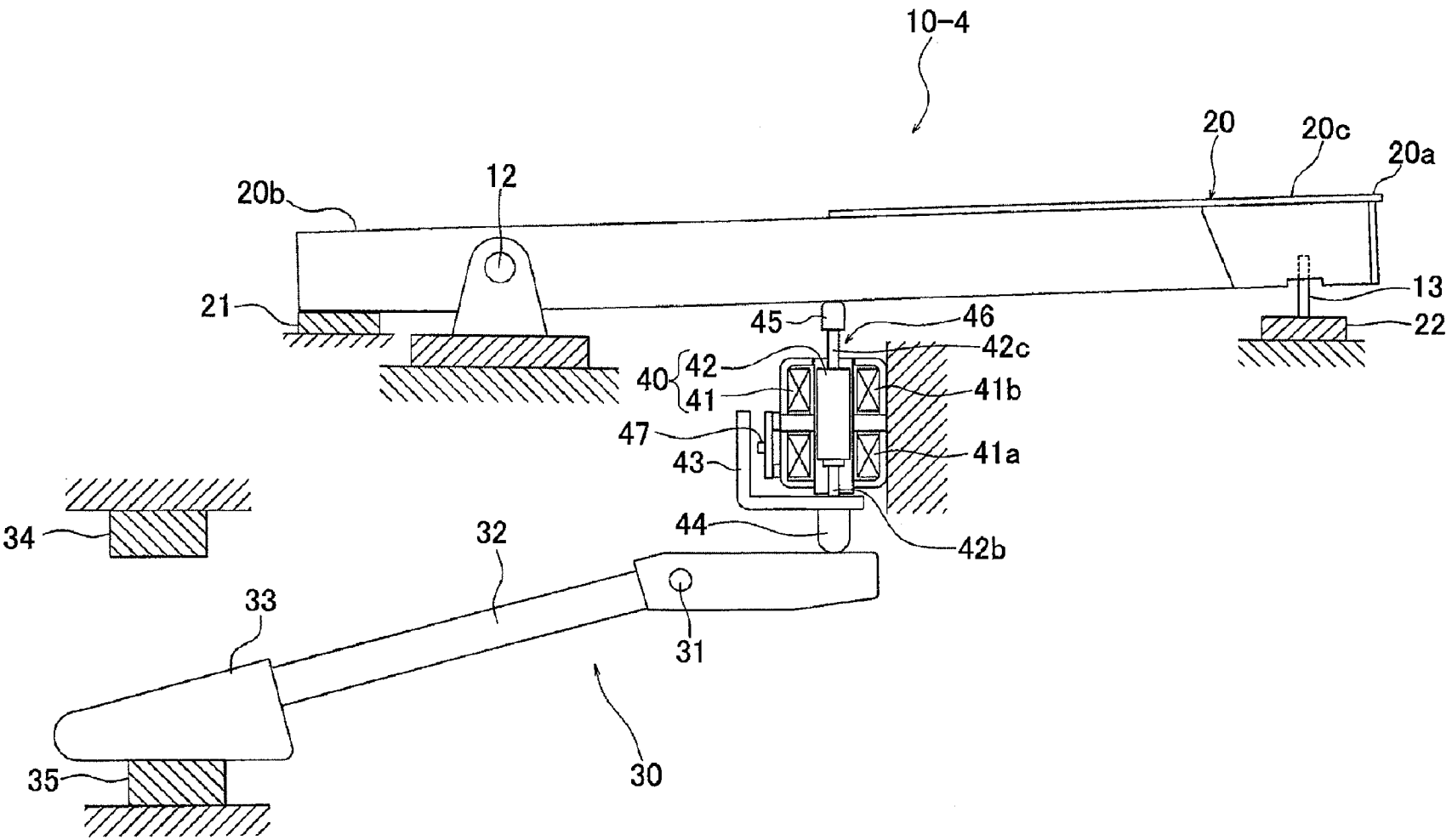
FIG. 10 is a schematic side view of a fourth embodiment of the keyboard apparatus of the present invention.

Next, a description will be given about a fourth embodiment of the keyboard apparatus of the present invention. FIG. 10 is a view showing a construction of the fourth embodiment of the keyboard apparatus 10-4. In the fourth embodiment of the keyboard apparatus 10-4, vertical positional relationship between the key 20 and the mass member 30 is reversed from that in the first embodiment of the keyboard apparatus 10, and hence an orientation of the electromagnetic actuator 40 provided between the key 20 and the mass member 30 is reversed from that in the first embodiment of the keyboard apparatus 10. Also, respective operating directions of the key 20, mass member 30 and electromagnetic actuator 40 are reversed from those in the first embodiment of the keyboard apparatus 10.

Namely, in the fourth embodiment of the keyboard apparatus 10-3, the mass member 30 is disposed under the key 20, and the electromagnetic actuator 40 and transmission member 46 are disposed between the lower surface of the key 20 and the mass member 30. In the transmission member 46, the upper end of the second rod 42*c* extending upward is held in abutment with a lower surface portion of the key 20 located forwardly of the key pivot point 12 (i.e., located on the same side as the key depression section 20*c* with respect to the key pivot point 12), and the lower end of the support member 44 fixed to the first rod 42*b* extending downward is held in abutment with an upper surface portion of the shank section 32 extending in an opposite direction from the mass member 33 with respect to the mass member pivot point 31.

Whereas the key 20, electromagnetic actuator 40 and transmission member 46 and mass member 30 in the first embodiment of the keyboard apparatus 10 are arranged from down to up in the order mentioned on a side (rear side) opposite from the key depression section 20*c* with respect to (i.e., as viewed from) the key pivot point 12, the key 20, the key 20, electromagnetic actuator 40 and transmission member 46 and mass member 30 in the fourth embodiment of the keyboard apparatus 10-4 are arranged from up to down in the order mentioned on the same front side as the key depression section 20*c* with respect to (i.e., as viewed from) the key pivot point 12.

In the fourth embodiment of the keyboard apparatus 10-4 too, when no depressing operation of the key 20 is being performed, the key 20 is held in the non-depressed position with the lower surface of the rear end region 20*b* of the key 20 held abutting against the upper key limit stopper 21, as shown in FIG. 10, because of both balance between self-weights before and behind the key pivot point 12 and the load applied from the mass member 30 to the key 20 via the transmission member 46. At that time, the mass member 30 is in its lower limit position abutting against the lower mass member limit stopper 35. Once the key 20 in the non-depressed position is depressed, the key 20 pivots about the key supporting position 12 while pushing downward the shank section 32 of the mass member 30 via the transmission member 46. In this manner, the key 20 pivots to the depressed position where the lower surface of the front end region 20*a* abuts against the lower key limit stopper 22. The mass member 30, having pivoted by being pushed downward by the key 20 via the plunger 42, is held in its upper limit position abutting against the upper mass member limit stopper 34 while the key 20 is in the depressed position. Then, once the key depressing force to the key 20 is removed, a load is applied from the pivoting mass member 30 to the key 20 via the transmission member 46, so that the key 20 returns to the non-depressed position because of both the applied load and the self-weight balance.

[Fifth Embodiment]

Next, a description will be given about a fifth embodiment of the keyboard apparatus of the present invention, which pertains to the second aspect of the present invention.

Figure 11:
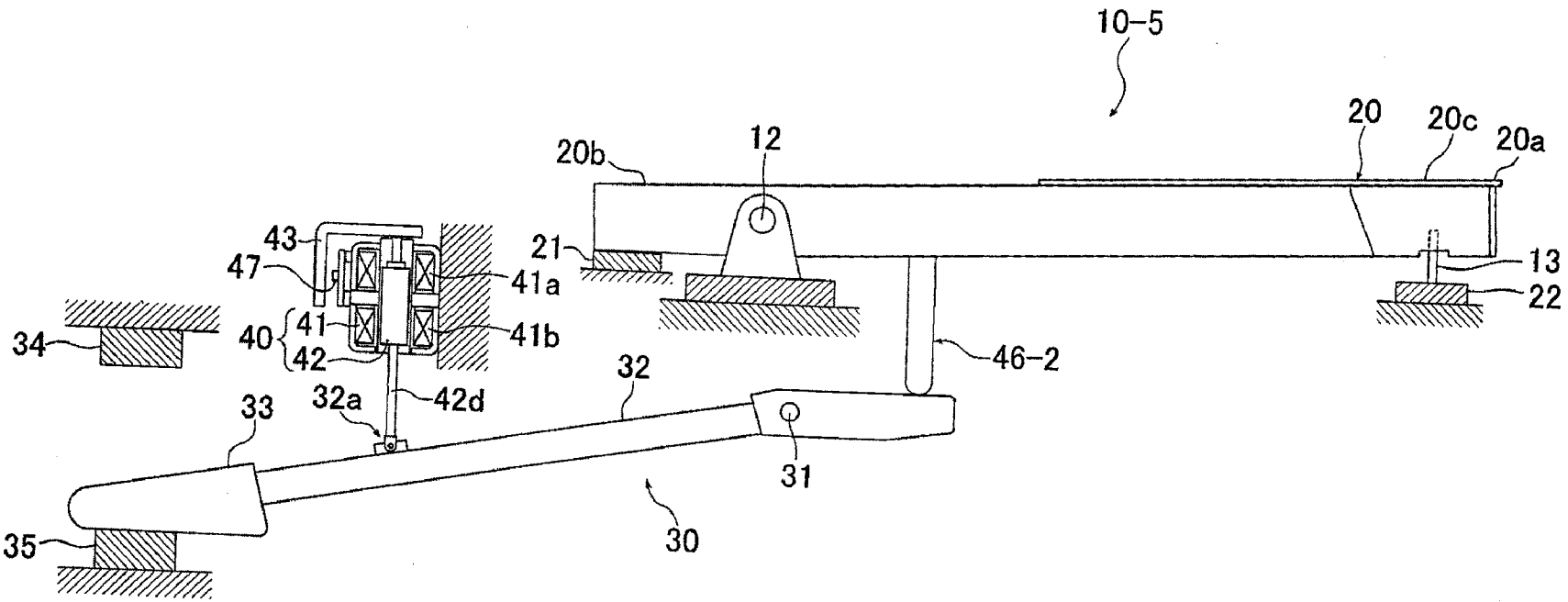
FIG. 11 is a schematic side view of a fifth embodiment of the keyboard apparatus of the present invention.

FIG. 11 is a view showing a construction of the fifth embodiment of the keyboard apparatus 10-5. In the fifth embodiment of the keyboard apparatus 10-5, vertical positional relationship between the key 20 and the mass member 30 is reversed from that in the first embodiment of the keyboard apparatus 10. Whereas the electromagnetic actuator 40 in the first embodiment of the keyboard apparatus 10 is provided between the key 20 and the mass member 30 so as to directly drive the key 20 and the mass member 30, the electromagnetic actuator 40 in the fifth embodiment is provided over the shank section 32 of the mass member 30 so as to directly drive the mass member 30. Thus, in the fifth embodiment of the keyboard apparatus 10-5, the electromagnetic actuator 40 imparts a driving force to the key 20 by way of the mass member 30.

More specifically, the plunger 42, which is driven in two directions (i.e. vertically upward and downward) by the electromagnetic actuator 40, has a rod 42*d* extending downward and connected at it lower end to a connection portion 32*a*, provided on the upper or side surface of the shank section 32, via a magnet or the like in such a manner that the rod 42*d* and hence the plunger 42 is movable relative to the shank section 32. In this way, reciprocating movement, by the electromagnetic actuator 40, of the plunger 42 and rod 42*d* acts as a driving force for pivoting the shank section 32, so that the mass member 30 and the key 20 are driven. Further, although the transmission member 46-2 provided between the key 20 and the mass member 30 is constructed to transmit a load from one of the key 20 and mass member 30 to the other in interlocked relation to movement of the key 20 and mass member 30, it is not driven by the electromagnetic actuator 40 as done in the first embodiment of the keyboard apparatus 10. Note that the rod 42*d* need not necessarily be magnetically connected to the connection portion 32*a* as long as the connection between the connection portion 32*a* and the rod 42*d* permits the vertical reciprocating movement of the rod 42*d* and the pivoting movement of the shank section 32 about the mass member pivot point 31; for example, although not particularly shown, the rod 42*d* may be connected to the connection portion 32*a* via a pin inserted in a connection hole loosely, i.e. with some gap between the pin and the edge of the connection hole.

Even in the case where the electromagnetic actuator 40 imparts a driving force to the key 20 by way of the mass member 30 as in the fifth embodiment of the keyboard apparatus 10-5, the electromagnetic actuator 40 can impart the key 20 with a driving force for adjusting the reaction force applied from the mass member 30 to the key 20. Thus, the fifth embodiment of the keyboard apparatus 10-5 too can perform both force sense control on depression operation of the key 20 and automatic operation of the key 20 through cooperation between the reaction force applied from the mass member 30 to the key 20 and the driving force imparted from the electromagnetic actuator 40. Namely, in response to depression operation on the key 20, force sense control is performed through cooperation between the reaction force applied from the mass member 30 to the key 20 and the driving force imparted from the electromagnetic actuator 40 to the key 20. Also, even in the absence of depression operation on the key 20, automatic operation of the key is permitted through the cooperation between the reaction force applied from the mass member 30 to the key 20 and the driving force imparted from the electromagnetic actuator 40 to the key.

Whereas various embodiments of the present invention have been described above, the present invention should not be construed as limited to the described embodiments and may be modified variously within the scope of the technical ideas set forth in the appended claims and the specification and drawings. For example, the roller 36 mounted on the shank section 32 in the first to third embodiments of the keyboard apparatus 10 and 10-3 may be replaced with any other suitable member as long as the replacing member is provided in detachable abutment with the transmission member 46 and can perform appropriate shock absorbing and sliding functions with respect to the transmission member 46. As an example, the roller 36 may be replaced with a bearing member including a contact portion with a spherical surface. Alternatively, the transmission member 46 may be abutted directly against the key 20 with the roller 36 omitted.

Further, the above-described various embodiments have been described above as applied to the electronic keyboard instrument having the electronic tone generator that generates a tone in response to operation of any one of the keys 20. Thus, in these described embodiments, each of the mass members 30 only has the function of merely imparting an inertial mass to the key 20 to create a key touch feeling approximate to that of a natural keyboard instrument, such as an acoustic piano; namely, the mass member 30 in each of the above-described embodiments does not have a function of actually striking a string to generate a tone. However, the keyboard apparatus of the present invention is not limited to such a described construction, and the mass member 30 may have the function of actually striking, like a hammer member of an acoustic piano, a string to generate a tone, in which case the mechanism for generating an electronic tone in response to operation of the key may be dispensed with.

Further, whereas, in the above-described various embodiments, the mass member 30 is constructed to pivot about the mass member pivot point 31, the movement of the mass member 30 provided in the keyboard apparatus of the present invention is not limited to such pivoting movement and may be linear or any other type of movement. Furthermore, the positional relationship between the key, the transmission member and the mass member is not limited to the vertical positional relationship as shown and described in relation to the embodiments. For example, although not particularly shown, the key and the mass member may be arranged side by side in the horizontal direction with the transmission member interposed therebetween, so that the movement of the key can be transmitted in the horizontal direction to the mass member via the transmission member. In such a case, the mass member may be constructed to either pivot or linearly move.

While the present invention has been particularly shown and described with reference to preferred embodiment thereof, it will be understood by those skilled in the art that the foregoing and other changes in form and details can be made therein without departing from the spirit and scope of the present invention. All modifications and equivalents attainable by one versed in the art from the present disclosure within the scope and spirit of the present invention are to be included as further embodiments of the present invention. The scope of the present invention accordingly is to be defined as set forth in the appended claims.

This application is based on, and claims priorities to, JP PA 2009-151651 filed on 25 Jun. 2009 and JP PA 2009-151652 filed on 25 Jun. 2009. The disclosures of the priority applications, in their entirety, including the drawings, claims, and the specifications thereof, are incorporated herein by reference.

What is claimed is:

1. A keyboard apparatus comprising:

a key supported for pivoting movement about a key pivot point;

a mass member that imparts a reaction force to performance operation of the key in interlocked relation to movement of the key;

a driving force imparting section that is provided between the key and the mass member and that imparts a driving force to the key and the mass member; and a control section that controls generation of the driving force by the driving force imparting section, wherein the driving force imparting section comprises an actuator that includes a transmission member provided in abutment with both of the key and the mass member to transmit a load from one of the key or the mass member to the other of the key or the mass member, and a drive source that drives the transmission member toward at least one of the key or the mass member, and wherein the transmission member is provided in detachable abutment with the key or the mass member so that the transmission member is disengageable from either the key or the mass member depending on operating conditions of the key and the mass member.

2. The keyboard apparatus as claimed in claim 1, wherein:

the mass member is provided for pivoting movement in a region over the key, and the transmission member is provided in abutment with a portion of the key located on an opposite side from a key depression section of the key with respect to the key pivot point and in abutment with the mass member.

3. The keyboard apparatus as claimed in claim 1, wherein the driving force imparting section is an electromagnetic actuator including a coil, which is the drive source, and a plunger, which is the transmission member, driven by the coil.

4. The keyboard apparatus as claimed in claim 3, further comprising:

at least one operation detection section that detects operation of at least one of the transmission member, the key, or the mass member, wherein the control section controls, on the basis of a detection result of the operation detection section, a driving force to be generated by the driving force imparting section.

5. The keyboard apparatus as claimed in claim 1, wherein:

the transmission member is linearly movable between the key and the mass member, and abutting angles between the transmission member and the key and between the transmission member and the mass member are set to minimize amounts of contacting-sliding movement of the transmission member relative to the key and the mass member responsive to movement of the key and the mass member.

6. The keyboard apparatus as claimed in claim 2, wherein the driving force imparting section is an electromagnetic actuator including a coil, which is the drive source, and a plunger, which is the transmission member, driven by the coil.

7. The keyboard apparatus as claimed in claim 2, further comprising:

at least one operation detection section that detects operation of at least one of the transmission member, the key, or the mass member, wherein the control section controls, on the basis of a detection result of the operation detection section, a driving force to be generated by the driving force imparting section.

8. The keyboard apparatus as claimed in claim 2, wherein:

the transmission member is linearly movable between the key and the mass member, and abutting angles between the transmission member and the key and between the transmission member and the mass member are set to minimize amounts of contacting-sliding movement of the transmission member relative to the key and the mass member responsive to movement of the key and the mass member.

9. The keyboard apparatus as claimed in claim 1, wherein:

the key is pivotable in a key depressing direction as the reaction force imparted from the mass member to the key is reduced by imparting the driving force by the driving force imparting section to the key, the control section provides force sense control when depression operation has been performed on the key, via the reaction force imparted from the mass member to the key and the driving force imparted from the driving force imparting section to the key, and the control section controls the movement of the key, even in absence of depression operation on the key by an operator, to provide automatic operation of the key via the reaction force imparted from the mass member to the key and the driving force imparted from the driving force imparting section to the key.

10. The keyboard apparatus as claimed in claim 9, wherein the driving force imparting section is a bi-directionally-driven actuator that drives the transmission member toward both of the key and the mass member.

11. The keyboard apparatus as claimed in claim 10, wherein:

the mass member is provided for pivoting movement in a region over the key, and the transmission member is provided in abutment with a portion of the key located on an opposite side from a key depression section of the key with respect to the key pivot point and in abutment with the mass member.

12. The keyboard apparatus as claimed in claim 9, wherein, when the key pivots in the key releasing direction during the automatic operation of the key, the key is imparted with, in addition to the reaction force from the mass member, the driving force generated by the driving force imparting section in the key releasing direction.

13. The keyboard apparatus as claimed in claim 11, wherein:

the control section provides the automatic operation of the key with the driving force imparted by the driving force imparting section based on automatic performance data stored in a storage section, and during the automatic operation of the key, operating velocities, in the key depressing and key releasing directions, of the key are controlled by driving forces acting in both of the key depressing and key releasing directions imparted to the key by the driving force imparting section based on the automatic performance data.

14. The keyboard apparatus as claimed in claim 9, further comprising:

at least one operation detection section that detects operation of at least one of the transmission member, the key, or the mass member, wherein the control section controls, on the basis of a detection result of the operation detection section, a driving force to be generated by the driving force imparting section.

15. The keyboard apparatus as claimed in claim 10, wherein, when the key pivots in the key releasing direction during the automatic operation of the key, the key is imparted with, in addition to the reaction force from the mass member, the driving force generated by the driving force imparting section in the key releasing direction.

16. The keyboard apparatus as claimed in claim 10, wherein:

the control section provides the automatic operation of the key with the driving force imparted by the driving force imparting section based on automatic performance data stored in a storage section, and during the automatic operation of the key, operating velocities, in the key depressing and key releasing directions, of the key are controlled by driving forces acting in both of the key depressing and key releasing directions imparted to the key by the driving force imparting section based on the automatic performance data.

17. The keyboard apparatus as claimed in claim 10, further comprising:

at least one operation detection section that detects operation of at least one of the transmission member, the key, or the mass member, wherein the control section controls, on the basis of a detection result of the operation detection section, a driving force to be generated by the driving force imparting section.

* * * * *